US008844481B2

(12) United States Patent
Nakamura

(10) Patent No.: US 8,844,481 B2
(45) Date of Patent: Sep. 30, 2014

(54) VARIABLE VALVE APPARATUS FOR INTERNAL COMBUSTION ENGINE

(75) Inventor: Makoto Nakamura, Zushi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 205 days.

(21) Appl. No.: 13/611,648

(22) Filed: Sep. 12, 2012

(65) Prior Publication Data

US 2013/0213329 A1 Aug. 22, 2013

(30) Foreign Application Priority Data

Feb. 21, 2012 (JP) ..... 2012-034608

(51) Int. Cl.
*F01L 1/34* (2006.01)

(52) U.S. Cl.
USPC ..... 123/90.16; 123/90.17

(58) Field of Classification Search
CPC ..... F01L 2001/34489; F01L 2001/34496; F01L 2001/34493
USPC ..... 123/90.15–90.17
See application file for complete search history.

(56) References Cited

U.S. PATENT DOCUMENTS 4,397,270 A 8/1983 Aoyama
5,645,020 A * 7/1997 Yamada ..... 123/90.17
6,568,361 B2 * 5/2003 Hara et al. ..... 123/90.29
8,210,143 B2 * 7/2012 Meusel et al. ..... 123/90.17
8,443,499 B2 * 5/2013 Clever et al. ..... 29/234

FOREIGN PATENT DOCUMENTS

JP 55-137305 A 10/1980
JP 2002-168105 A 6/2002
JP 2011-174416 A 9/2011

OTHER PUBLICATIONS

A. C. Elrod et al., "Development of a Variable Valve Timed Engine to Eliminate the Pumping Losses Associated with Throttle Operation", SAE Technical Paper Series, International Congress and Exposition, Detroit, Michigan, Feb. 24-28, 1986, No. 860537.

* cited by examiner

*Primary Examiner* — Thomas Denion
*Assistant Examiner* — Daniel Bernstein
(74) *Attorney, Agent, or Firm* — Foley & Lardner LLP

(57) ABSTRACT

A variable valve apparatus for an internal combustion engine includes a control shaft, a camshaft having first and second camshaft members rotatable relative to each other, a rotary cam rotating together with the second camshaft member for opening and closing of an exhaust valve, an eccentric drive cam rotating together with the first camshaft member, a rocker arm caused to swing with rotation of the eccentric drive cam, a swing cam caused to swing by the rocker arm for opening and closing of an intake valve, a control cam formed on the control shaft to change an operating position of the rocker arm according to a rotational phase of the control shaft and vary the amount of swinging movement of the swing cam, a phase control mechanism adapted to control a relative rotational phase of the first and second camshaft members and an actuator for rotating the control shaft.

20 Claims, 14 Drawing Sheets

VARIABLE VALVE APPARATUS FOR INTERNAL COMBUSTION ENGINE

BACKGROUND OF THE INVENTION

The present invention relates to a variable valve apparatus for varying the open/close timing or lift amount of engine valves in an internal combustion engine.

Japanese Laid-Open Patent Publication No. 2002-168105 discloses a variable valve apparatus for an automotive internal combustion engine, which includes a camshaft arranged on an exhaust side (referred to as "exhaust camshaft"), a fixed cam integrally mounted on the exhaust camshaft so as to drive an exhaust valve, a control shaft arranged on an intake side, a control cam fixed to the control shaft, a swing cam swingably mounted on the control shaft, a rocker arm swingably supported by the control cam, an eccentric drive cam integrally mounted on the exhaust camshaft and connected to the swing cam through the rocker arm and link members so as to drive an intake valve via the swing cam and an actuator for controlling the rotational phase of the control shaft (control cam) to change the operating position of the rocker arm and thereby vary the position of contact of the swing cam with a valve lifter of the intake valve. In this configuration, the variable valve apparatus is capable of varying the valve lift characteristics of the intake valve while reducing its height dimension for improvement in mountability.

SUMMARY OF THE INVENTION

In the above conventional type of variable valve apparatus, however, the eccentric drive cam and the fixed cam serve as an intake valve drive cam and an exhaust valve drive cam, respectively. The relationship between the valve lift characteristics of the intake and exhaust valves is uniquely defined as both of the intake valve drive cam and the exhaust valve drive cam are integrally mounted on the same camshaft. In other words, the relationship between the valve timing of the intake valve and the valve timing of the exhaust valve may largely deviate from its theoretical relationship depending on the operating angle of the intake valve. This can cause problems such as increase in pumping loss and excessive increase in residual gas.

In view of the above problems, it is an object of the present invention to provide a variable valve apparatus capable of, while maintaining good mountability on an internal combustion engine, securing good relationship between the open/close timing of first and second engine valves even though the operating angle of the second engine valve becomes changed.

According to one aspect of the present invention, there is provided a variable valve apparatus for an internal combustion engine, comprising: a control shaft rotatably arranged on a cylinder head of the internal combustion engine; a camshaft rotatably arranged on the cylinder head of the internal combustion engine and having a first camshaft member to which rotation of a crankshaft of the internal combustion engine is transmitted and a second camshaft member inserted and supported in an axial hole of the first camshaft member such that the first and second camshaft members are rotatable relative to each other; a rotary cam mounted on the second camshaft member so as to rotate together with the second camshaft member and allow opening and closing operations of an exhaust valve; an eccentric drive cam mounted on the first camshaft member so as to rotate together with the first camshaft member; a rocker arm swingably supported on the control shaft and caused to swing with rotation of the eccentric drive cam; a swing cam swingably supported on the control shaft and caused to swing with swinging movement of the rocker arm and allow opening and closing operations of an intake valve; a control cam formed eccentrically on the control shaft so as to rotate together with the control shaft, change an operating position of the rocker arm according to a rotational phase of the control shaft and thereby vary the amount of swinging movement of the swing cam; a phase control mechanism adapted to control a rotational phase of the second camshaft member relative to the first camshaft member; and an actuator for rotating the control shaft.

According to another aspect of the present invention, there is provided a variable valve apparatus for an internal combustion engine, comprising: a control shaft rotatably arranged on a cylinder head of the internal combustion engine; a camshaft rotatably arranged on the cylinder head of the internal combustion engine and having a first camshaft member to which rotation of a crankshaft of the internal combustion engine is transmitted and a second camshaft member inserted and supported in an axial hole of the first camshaft member such that the first and second camshaft members are rotatable relative to each other; a phase control mechanism disposed at one end of the camshaft and adapted to control a rotational phase of the second camshaft member relative to the first camshaft member; a rotary cam mounted on one of the first and second camshaft members so as to rotate together with the one of the first and second camshaft members and allow opening and closing operations of an exhaust valve; an eccentric drive cam mounted on the other of the first and second camshaft members so as to rotate together with the other of the first and second camshaft members; a rocker arm swingably supported on the control shaft and caused to swing with rotation of the eccentric drive cam; a swing cam swingably supported on the control shaft and caused to swing with swinging movement of the rocker arm and allow opening and closing operations of an intake valve; a control cam formed eccentrically on the control shaft so as to rotate together with the control shaft, change an operating position of the rocker arm according to a rotational position of the control shaft and thereby control the amount of swinging movement of the swing cam; and an actuator for rotating the control shaft.

According to still another aspect of the present invention, there is provided a variable valve apparatus for an internal combustion engine, comprising: a control shaft rotatably arranged on an cylinder head of the internal combustion engine; a camshaft rotatably arranged on an cylinder head of the internal combustion engine and having a first camshaft member to which rotation is transmitted from the internal combustion engine and a second camshaft member with a center thereof passing through the first camshaft member; a phase control mechanism disposed at one end of the camshaft and adapted to control a rotational phase of the second camshaft member relative to the first camshaft member; a rotary cam mounted on one of the first and second camshaft members so as to rotate together with the one of the first and second camshaft members and allow opening and closing operations of either one of intake and exhaust valves; a drive cam mounted on the other of the first and second camshaft members so as to rotate together with the other of the first and second camshaft members; a transmission mechanism for converting rotation of the drive cam to swinging movement and transmitting the swinging movement; a swing cam swingably supported on the control shaft and caused to swing with the swinging movement of the transmission mechanism and allow opening and closing operations of the other of the intake and exhaust valves; a control member integrally mounted on the control shaft and adapted to control the amount of the swinging movement of the transmission mechanism according to an operating position thereof; and an actuator for rotating the control shaft.

In each of the above aspects of the present invention, the camshaft is double-structured with the first and second camshaft members, by one of which the rotary cam is driven to operate the first engine valve and by the other of which the swing cam is driven to operate the second engine valve; and the relative rotational phase of the first and second camshaft members is controlled by the phase control mechanism. It is therefore possible according to the present invention to, while securing good mountability of the variable valve apparatus on the internal combustion engine, prevent inconvenience on the relationship between the open/close timing of the first and second engine valves even though the operating angle of one of the second engine valve becomes changed.

The other objects and features of the present invention will also become understood from the following description.

DESCRIPTIONS OF THE EMBODIMENTS

Figure 1:
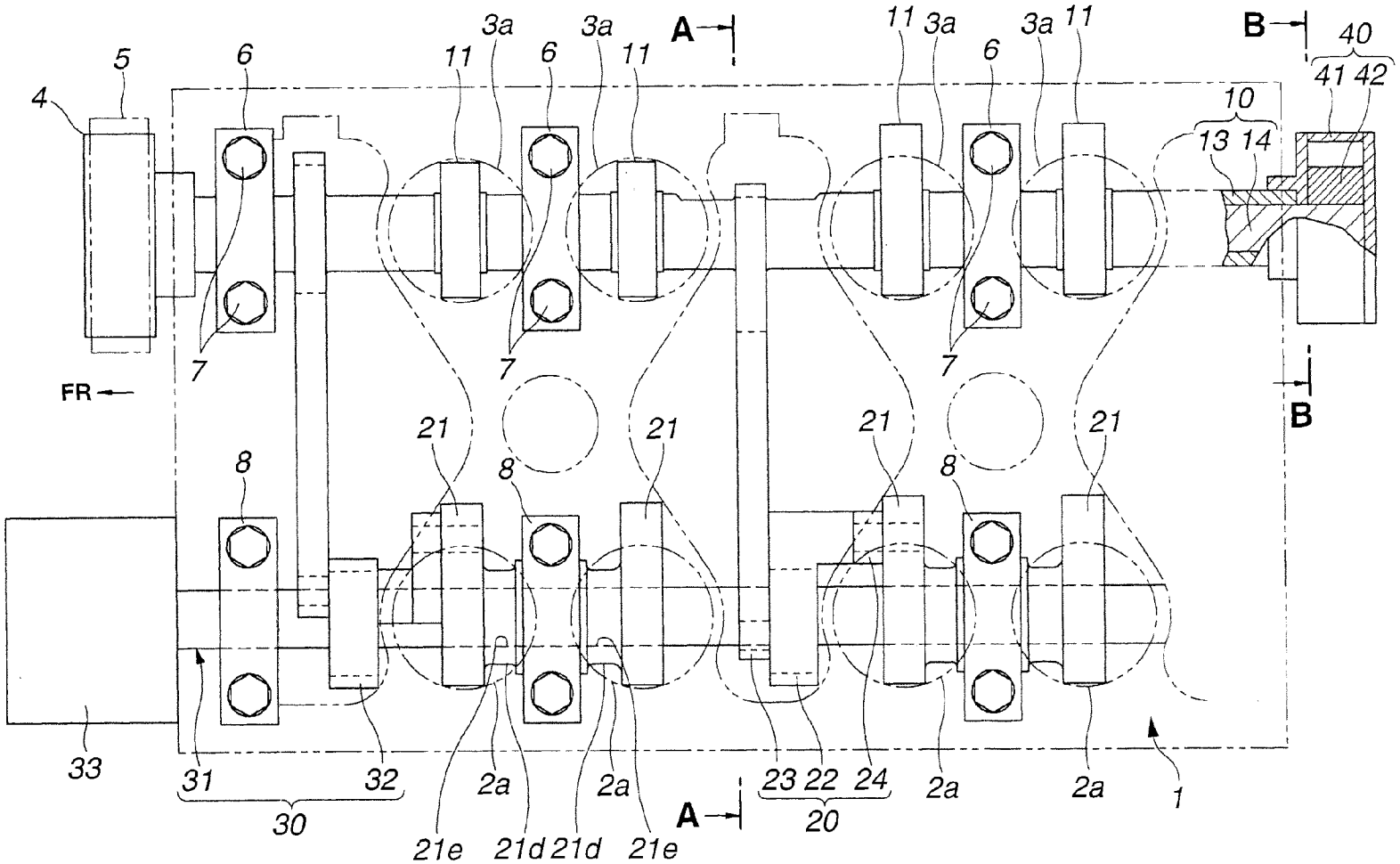
FIG. 1 is a plan view of a variable valve apparatus for an internal combustion engine, in a condition that a cylinder head cover of the engine is detached, according to a first embodiment of the present invention.

The present invention will be described in detail below by way of the following first to fourth embodiments, in which like parts and portions are designated by like reference numerals to thereby omit repeated descriptions thereof. Herein, each of the first to fourth embodiments specifically refers to a variable valve apparatus for an internal combustion engine in which each cylinder has two intake valves and two exhaust valves.

First Embodiment

Figure 2:
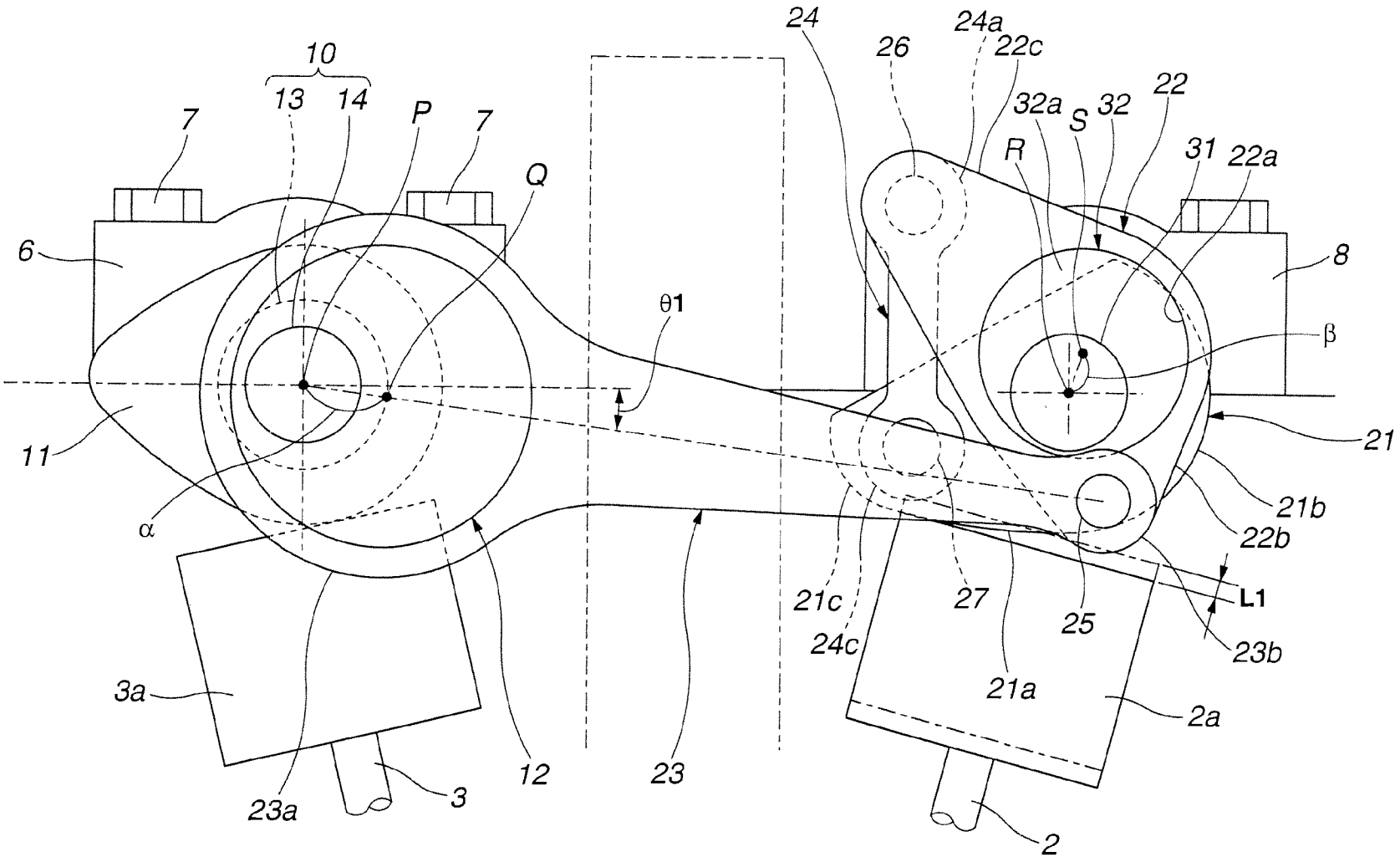
FIGS. 2 and 3 are cross-section views taken along line A-A of FIG. 1 and showing small- and large-lift control states of the variable valve apparatus, respectively, according to the first embodiment of the present invention.
Figure 3:
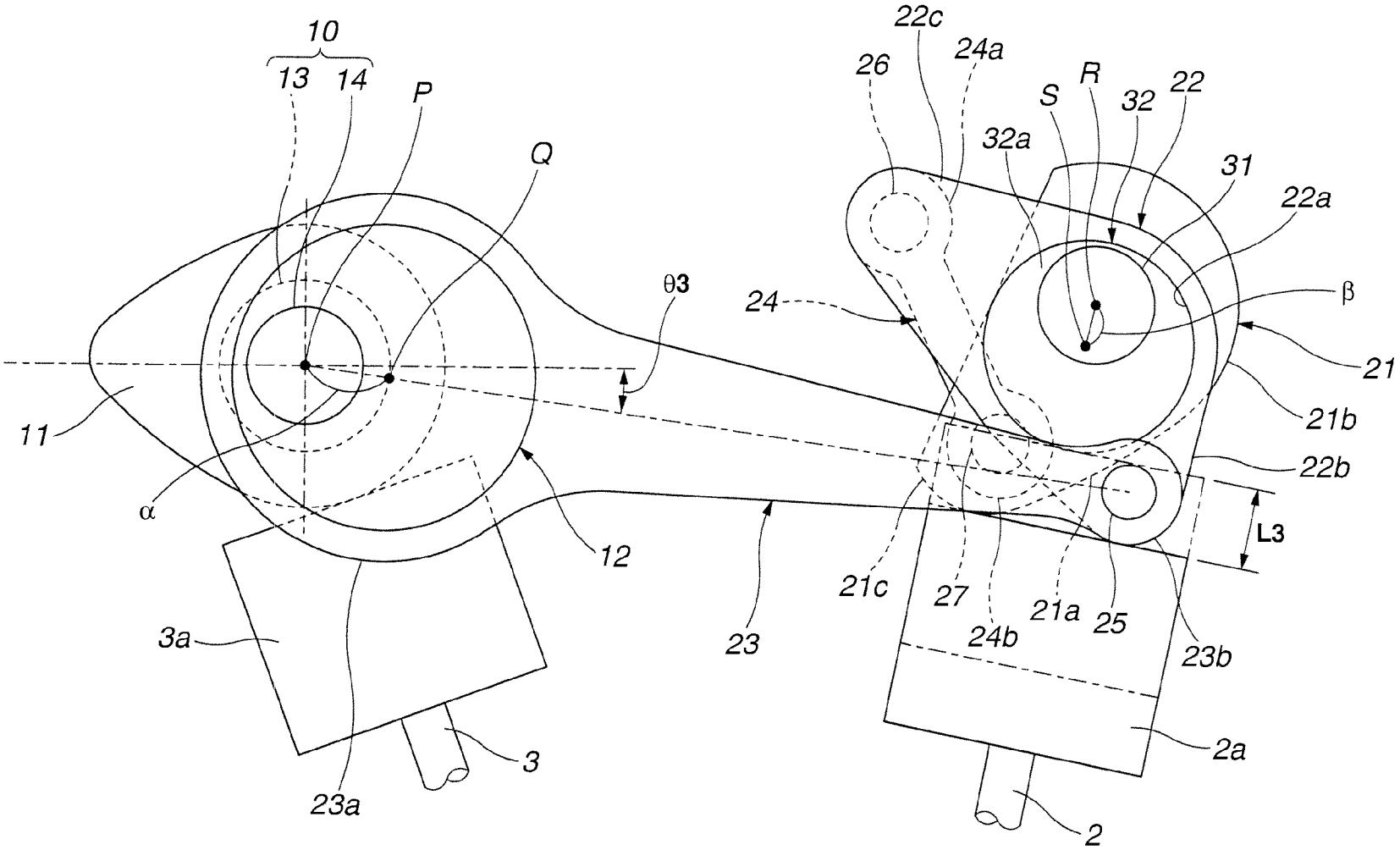

As shown in FIGS. 1 to 3, the variable valve apparatus according to the first embodiment is located above a cylinder head 1 of the internal combustion engine and is equipped with an exhaust camshaft 10, a control shaft 31 (corresponding to an intake camshaft), control cams 32, eccentric drive cams 12, rotary cams 11, swing cams 21, a transmission mechanism 20, a variable valve even and lift mechanism 30 and a phase control mechanism 40.

The exhaust camshaft 10 is arranged as a drive shaft in a front-rear direction of the engine and is rotatably attached by bolts 7 to brackets 6 on an upper side of the engine cylinder head 1. A pulley 4, around which a timing belt 5 is wound, is disposed on a front end of the exhaust camshaft 10.

Figure 4:
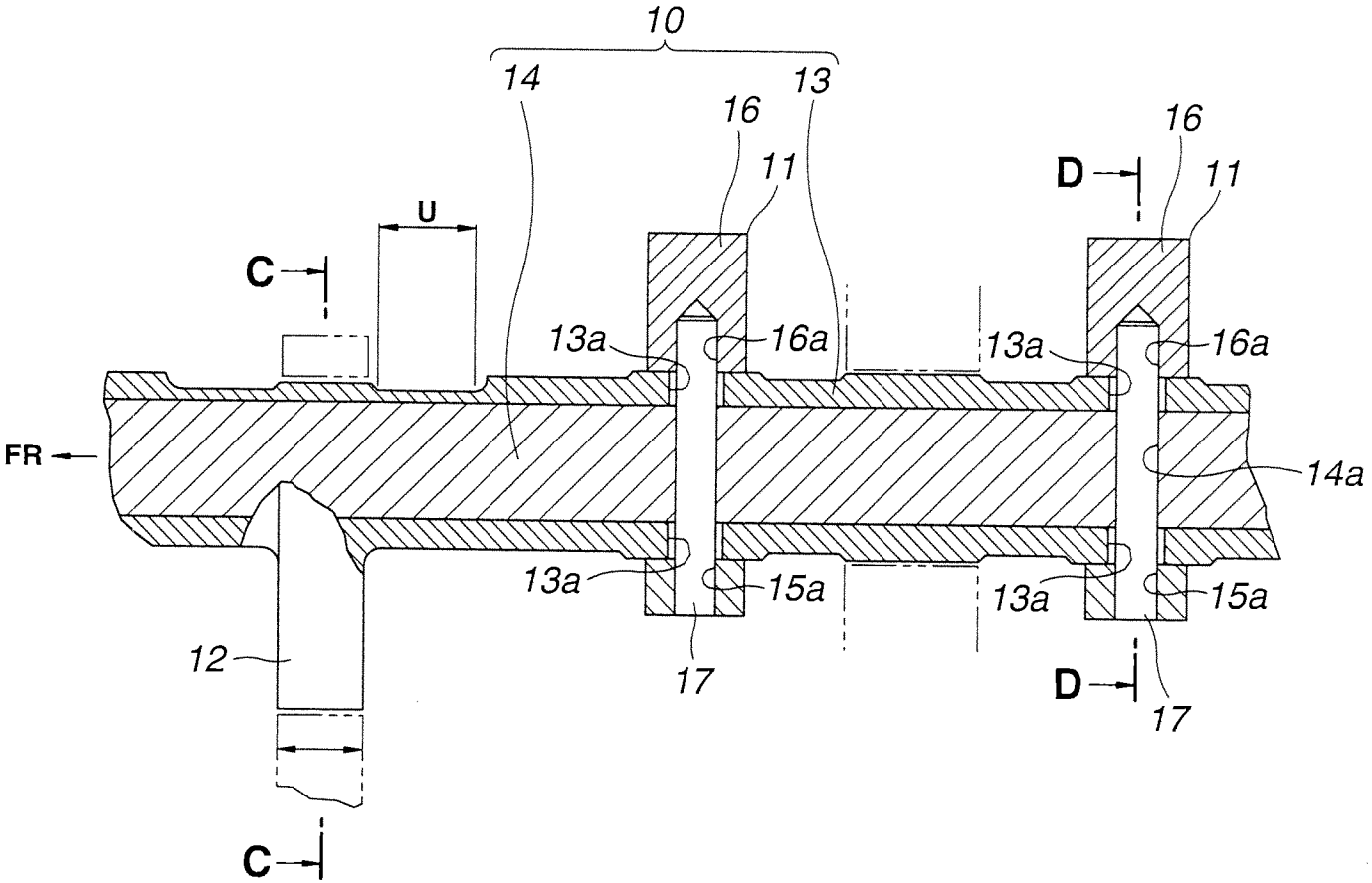
FIG. 4 is a cross-section view of substantial part of an exhaust camshaft of the variable valve apparatus according to the first embodiment of the present invention.

In the first embodiment, the exhaust camshaft 10 has a double structure formed with a hollow outer camshaft member 13 (as a first camshaft member) and a solid inner camshaft member 14 (as a second camshaft member) as shown in FIGS. 1 and 4. The outer camshaft member 13 is rotatably supported by the brackets 6 and connected to the pulley 4 such that, when rotation of a crankshaft of the engine is transmitted to the outer camshaft member 13 via the pulley 4 and the timing belt 5, the outer camshaft member 13 rotates in synchronism with the rotation of the engine crankshaft. The inner camshaft member 13 is rotatably and coaxially inserted through an axial hole of the outer camshaft member 13.

The rotary cams 11 are provided in a pair per engine cylinder and is integrally mounted on the outer camshaft member 13, at positions axially corresponding to respective exhaust valves 3, so as to rotate together with the outer camshaft member 13. As shown in FIGS. 2 and 3, the rotary cams 11 are raindrop-shaped with the same cam profile and have outer circumferential surfaces held in sliding contact with upper surfaces of valve lifters 3*a* of the exhaust valves 3 so as to open and close the exhaust valves 3 by rotation thereof.

The eccentric drive cams 12 are integrally mounted on the inner camshaft member 14, at positions between the adjacent engine cylinders and adjacent to lateral sides of the rotary cams 11 but axially apart from the exhaust valve lifters 3*a*, so as to rotate together with the inner camshaft member 14. As shown in FIGS. 2 and 3, each of the eccentric drive cams 12 is eccentric relative to the rotary cam 11 and has a center Q offset by a predetermined amount α from a center P of the exhaust camshaft 10.

The control shaft 31 is arranged in parallel with the exhaust camshaft 10 and rotatably attached by bolts to brackets 8 on the upper side of the engine cylinder head 1.

The control cams 32 are fixed as control members to the control shaft 31 at positions corresponding to the eccentric drive cams 12. As shown in FIGS. 2 and 3, each of the control cams 32 has a center S offset by a predetermined amount β from a center R of the control shaft 31.

As will be explained later, the control shaft 31 and the control cams 32 constitute a part of the variable valve event and lift mechanism 30 to adjust the control amount of the variable valve event and lift mechanism 30.

The swing cams 21 are provided in a pair per engine cylinder and is swingably supported on the control shaft 31 at positions axially corresponding to respective intake valves 2. In the first embodiment, the swing cams 21 have a different shape from the raindrop shape of the rotary cams 11. More specifically, the swing cams 21 have rounded cam surfaces 21*a* and base circle surfaces 21*b* as shown in FIGS. 2 and 3. The cam surfaces 21*a* are formed with the same profile over approximately half of outer circumferences of the swing cams 21 and are held in sliding contact with upper surfaces of valve lifters 2*a* of the intake valves 2 so as to open and close the intake valves 2 by swinging movement thereof. The base circle surfaces 21*b* are formed on cylindrical base end portions 21*d* of the swing cams 21. The swing cams 21 also have front end portions (cam nose portions) 21*c* formed with pin insertion holes. In each of the swing cam 21, a given region of the base circle surface 21*b* is defined as a base circle region; a given region from the base circle region to the cam surface 21*a* is defined as a ramp region; and a given region from the ramp region to the cam nose portion 21*c* is defined as a lift region. The cylindrical base end portions 21 of each pair of the swing cams 21 are joined together, thereby constituting a sliding shaft of slightly large diameter to form a bearing with an inner circumferential portion of the bracket 8. Inner circumferential parts of the base end portions 21*d* of the swing cams 21 are formed with shaft insertion holes 21*e* so that the control shaft 31 is rotatably inserted through the shaft insertion holes 21*e*, whereas outer circumferential parts of the base end portions 21*d* of the swing cams 21 are rotatably supported by the brackets 8.

The transmission mechanism 20 is adapted to convert rotation of the eccentric drive cams 12 to linear movement and transmit the linear movement as a driving force to the swing cams 21. In the first embodiment, the transmission mechanism 20 has a rocker arm 22, a link arm 23 and a link rod 24 per engine cylinder as shown in FIG. 1.

As shown in FIGS. 2 and 3, the rocker arm 22 is substantially triangular in shape. A cam insertion hole 22*a* is formed in a center base portion of the rocker arm 22 so that the rocker arm 22 is swingably supported by the control cam 32 upon insertion of the control cam 32 into the cam insertion hole 22*a*. Pin insertion holes are also formed in opposite ends 22*b* and 22*c* of the rocker arm 22.

The link arm 23 is formed into a linear shape and arranged along a width direction of the engine so as to extend between the exhaust camshaft 10 and the control shaft 31 and link the one end 22*b* of the rocker arm 22 to the eccentric drive cam 12. In the first embodiment, the link arm 23 has a large-diameter base end portion 23*a* and a small-diameter protruding end portion 23*b* protruding from the base end portion 23*a* as shown in FIGS. 2 and 3. The base end portion 23*a* of the link arm 23 is fitted around the eccentric drive cam 12. The protruding end portion 23*b* of the link arm 23 is formed with a pin insertion hole and rotatably connected to the one end 22*b* of the rocker arm 22 by press fitting a pin 25 into their respective pin insertion holes.

The link rod 24 is formed into a short straight shape so as to link the other end 22*c* of the rocker arm 22 to the cam nose portion 21*c* of one of the pair of the swing cam 21. As shown in FIGS. 2 and 3, pin insertion holes are formed in circular ends 24*a* and 24*b* of the link rod 24. The one end 24*a* of the link rod 24 is rotatably connected to the end 22*c* of the rocker arm 22 by press fitting a pin 26 into their respective pin insertion holes. The other end 24*b* of the link rod 24 is rotatably connected to the cam nose portion 21*c* of the swing cam 21 by fitting a pin 27 into their respective pin insertion holes.

The variable valve event and lift mechanism 30 is adapted to vary the valve lift characteristics (lift amount/operating angle) of the intake valves 2 by controlling the rotational phase of the control shaft 31 (control cams 32), changing the operating position of the rocker arms 22 and thereby varying the position of contact of the swing cams 21 with the intake valve lifters 2*a*. As shown in FIG. 1, the variable valve event and lift mechanism 30 has an actuator 33 in addition to the control shaft 31 and the control cams 32.

The actuator 33 is disposed on a front end portion of the engine cylinder head 1 and operated under various control signals from an electronic control unit so as to cause rotation of the control shaft 31 within a given angular range according to engine operating conditions.

Figure 9:
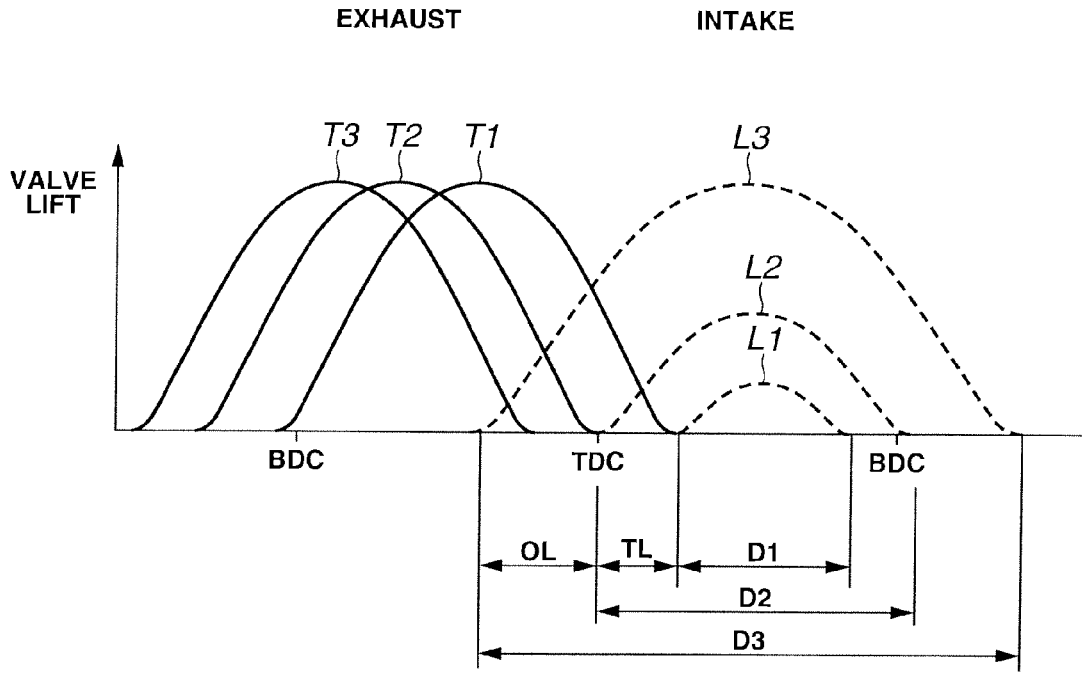
FIG. 9 is a graph showing the valve lift characteristics of intake and exhaust valves controlled by the variable valve apparatus according to the first embodiment of the present invention.

In the first embodiment, the control shaft 31 is controlled to a middle lift position such that the lift amount (operating angle) of the intake valves 2 is set to a middle lift amount L2 (middle operating angle D2) at the time of start of the engine as shown in FIG. 9. In the case of decreasing the lift amount (operating angle) of the intake valves 2, the control shaft 31 is rotated by the actuator 33 in such a manner that a large thickness portion (body portion) 32*a* of the control cam 32 is located upwardly as shown in FIG. 2. In the case of increasing the lift amount (operating angle) of the intake valves 2, the control shaft 31 is rotated by the actuator 33 in such a manner that the large thickness portion 32*a* of the control cam 32 is located downwardly as shown in FIG. 3.

The phase control mechanism 40 is adapted as a phase control mechanism and disposed between the outer and inner camshaft members 13 and 14 at a rear end of the exhaust camshaft 10 so as to cause relative rotation between the outer and inner camshaft members 13 and 14.

Figure 5:
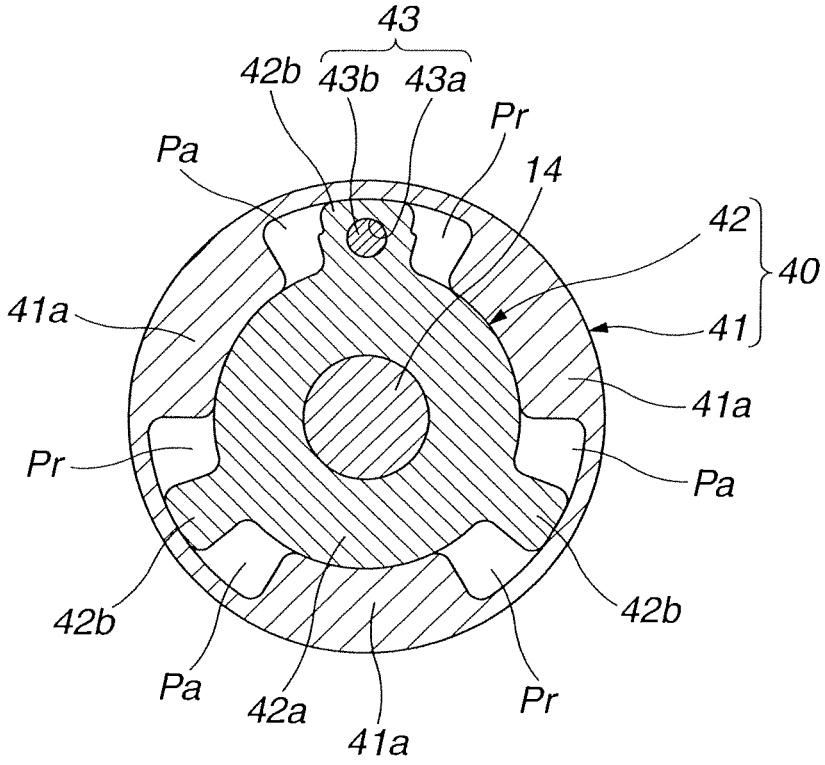
FIG. 5 is a cross-section view taken along line B-B of FIG. 1 and showing a phase control mechanism of the variable valve apparatus according to the first embodiment of the present invention.

As shown in FIG. 5, the phase control mechanism 40 has a known vane-type valve timing control structure formed with a substantially cylindrical housing 41 and a vane rotor 42 (as a vane member) in the first embodiment. The housing 41 is fixed to a rear end portion of the outer camshaft member 13 so as to rotate together with the outer camshaft member 13. The vane rotor 42 is rotatably accommodated in the housing 41 and fixed to a rear end portion of the inner camshaft member 14 so as to rotate together with the inner camshaft member 14. Three shoes 41*a* are formed protrudingly from an inner circumferential surface of the housing 41 and brought into contact with an annular base portion 42*a* of the vane rotor 42, whereas three vanes 42*b* are formed protrudingly from an outer circumferential surface of the rotor base portion 42*a* in correspondence with the respective shoes 41*a*. There are defined advance and retard hydraulic chambers Pa and Pr by the shoes 41*a* and the vanes 42*b* within the housing 41. The phase control mechanism 40 can thus control the rotational phase of the inner camshaft member 14 relative to the outer camshaft member 13 according to the rotational phase of the vane rotor 42 relative to the housing 41 by the selective supply and discharge of hydraulic pressure to and from the hydraulic chambers Pa and Pr under the control of a hydraulic control valve unit.

Figure 7:
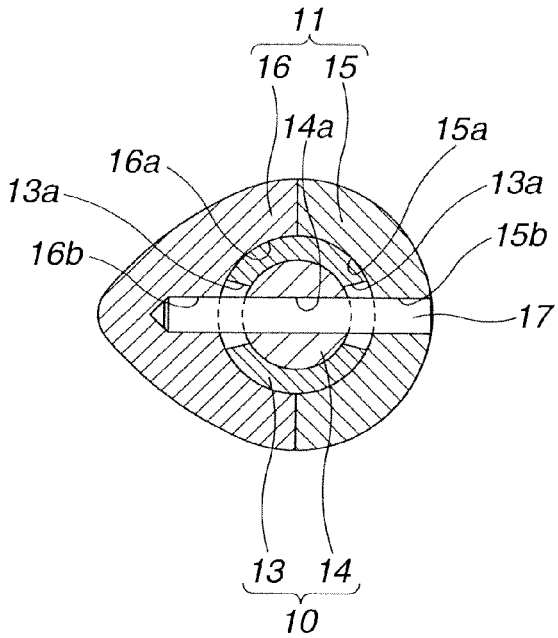
FIG. 7 is a cross-section view taken along line D-D of FIG. 4 and showing a rotary cam of the variable valve apparatus, when being controlled to a middle phase position, according to the first embodiment of the present invention.

In the first embodiment, the vane rotor 42 is controlled to a middle phase position (i.e., the inner camshaft member 14 is controlled to a middle phase position relative to the outer camshaft member 13; see FIG. 7) such that the valve lift curve (open/close timing) of the exhaust valves 3 is set to a middle phase T2 as shown in FIG. 9 at the time of start of the engine.

Further, an engagement hole 43*a* is formed in one of the vanes 42*b*; and a lock pin 43*b* is elastically retained by a spring (not shown) on a lateral side of the vane 42*b*. The engagement hole 43*a* and the lock pin 43*b* constitutes a known type of lock mechanism 43 to prevent free movement of the vane rotor 42 upon engagement of the lock pin 43*b* in the engagement hole 43 in the first embodiment. By the operation of the lock mechanism, the inner camshaft member 14 can rotate in synchronism with the outer camshaft member 13 while being maintained at the middle phase position relative to the outer camshaft member 13. In the first embodiment, the lock mechanism 43 is adapted to, when the vane rotor 42 is controlled to the middle phase position upon satisfaction of the engine stop conditions, hydraulically move the lock pin 43*b* into in the engagement hole 43*a* under the elastic force of the spring and thereby restrict the rotation of the vane rotor 42 relative to the housing 41.

Figure 6:
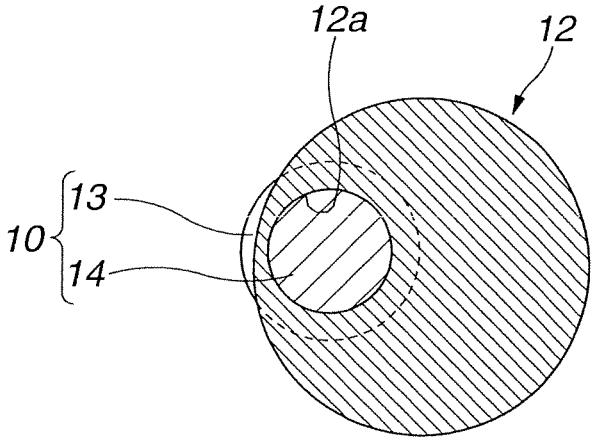
FIG. 6 is a cross-section view taken along line C-C of FIG. 4 and showing an eccentric drive cam of the variable valve apparatus according to the first embodiment of the present invention.

As shown in FIG. 6, each of the eccentric drive cams 12 is integral with the outer camshaft member 13. A shaft insertion hole 12*a* is formed in the eccentric drive cam 12 about the center P of the outer camshaft member 13 (exhaust camshaft 10) such that the inner camshaft member 14 is inserted into the shaft insertion holes 12*a*.

In this integral configuration, each of the rotary cams 11 is formed with two pieces, one of which is a base circle cam lobe 15 located on a base end side to define a base circle region and the other of which is a lift cam lobe 16 located on a cam nose side to define a lift region, as shown in FIG. 7. The rotary cam 11 is disposed around the outer camshaft member 13 in such a manner as to hold the outer camshaft member 13 between arc-shaped mating surfaces 15*a* and 16*a* of the cam lobes 15 and 16 and made rotatable together with the inner camshaft member 14 by insertion of a fixing pin 17 in the rotary cam 11 (cam lobes 15 and 16) and the outer and inner camshaft members 13 and 14.

Figure 8A:
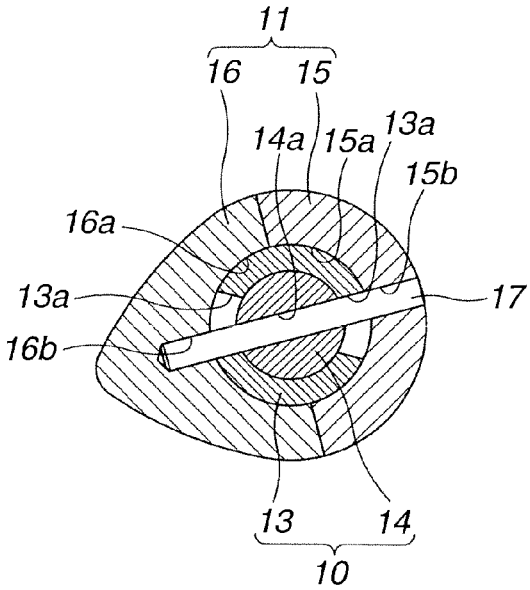
FIGS. 8A and 8B are cross-section views taken along line D-D of FIG. 4 and showing operating states of the rotary cam during phase retard control and phase advance control, respectively, according to the first embodiment of the present invention.
Figure 8B:
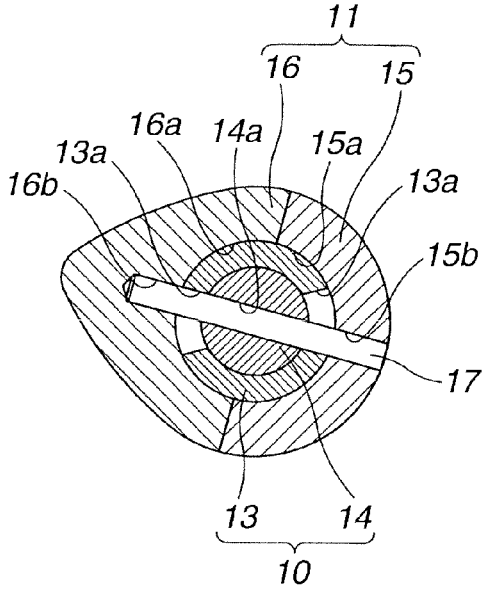

As shown in FIGS. 7, 8A and 8B, a pin engagement hole 15*b* is formed through a circumferentially middle portion of the cam lobe 15 so as to extend radially from the mating surface 15*a* of the cam lobe 15. A pin engagement hole 16*b* is also formed in a circumferentially middle portion of the lift cam lobe 16 so as to extend radially from the mating surface 16*a* toward the cam nose of the cam lobe 16. Each of the pin engagement holes 15*b* and 16*b* has an inner diameter slightly smaller than an outer diameter of the fixing pin 17. The cam lobes 15 and 16 are coupled together and assembled into the rotary cam 11 by press fitting the fixing pin 17 in the pin engagement holes 15*b* and 16*b* of the cam lobes 15 and 16.

As the inner shaft member 14 is sandwiched between the cam lobes 15 and 16 with an outer circumferential surface of the inner shaft member 14 slightly spaced apart from the cam lobes 15 and 16, the rotary cam 11 can be easily and simply fixed by the fixing pin 17 to the inner shaft member 14.

For the insertion of the fixing pin 17, a pin insertion hole 14*a* is formed radially through the inner camshaft member 14. The pin insertion hole 14*a* has an inner diameter slightly smaller than the outer diameter of the fixing pin 17 such that the fixing pin 17 is held in a press fitted state in the pin insertion hole 14*a* of the inner camshaft member 14 for improvement in support rigidity.

It is alternatively feasible to fit the fixing pin 17 loosely in the pin insertion hole 14*a* of the inner camshaft member 14 with a slight radial clearance left between the fixing pin 17 and the pin insertion hole 14*a*. This allows slight play between the inner camshaft member 14 and the fixing pin 17 so that, even if there occurs a deviation between the center of the outer camshaft member 13 and the center of the inner camshaft member 14, such a deviation can be absorbed by the radial clearance for smooth rotation of the rotary cams 11 (cam lobes 15 and 16) together with the inner camshaft member 14 relative to the outer camshaft member 13.

By contrast, a pair of opposing pin insertion slits 13*a* are formed in the outer camshaft member 13 at positions facing opening ends of the pin insertion hole 14*a* for the insertion of the fixing pin 17. The pin insertion slits 13*a* have some length along a circumferential direction of the outer camshaft member 13 so as to allow a given amount of relative rotation between the outer and inner camshaft members 13 and 14. Namely, the relative rotation of the outer and inner camshaft members 13 and 14 is allowed within the range of movement of the fixing pin 17 in the pin insertion slits 13*a* and is restricted by contact of the fixing pin 17 with ends of the pin insertion slits 13*a*.

The operations of the variable valve apparatus according to the first embodiment will be explained in more detail below with reference to FIGS. 2 and 3.

When the eccentric drive cam 12 rotates together with the exhaust camshaft 10, the rotation of the eccentric drive cam 12 is converted to liner movement of the link arm 23. By such linear movement of the link arm 23, the rocker arm 22 swings to move the link rod 24 and thereby cause swinging movement of the swing cams 21. The intake valves 2 are opened and closed by swinging movement of the swing cams 21. At this time, the valve lift characteristics of the intake valves 2 are controlled by the variable valve event and lift mechanism 30 according to the operating conditions of the engine. As mentioned above, the lift amount (operating angle) of the intake valves 2 is set to the middle lift amount L2 (middle operating angle D2) as shown in FIG. 9 as the control shaft 31 is controlled to the middle lift position at the time of start of the engine.

On the other hand, when the rotary cams 11 rotate together with the exhaust camshaft 10, the exhaust valves 3 are opened and closed with the rotation of the rotary cams 11. As no variable valve event and lift mechanism is provided to the exhaust valves 3, the valve lift characteristics of the exhaust valves 3 are fixed at the same level depending on the cam profile of the rotary cams 11 as shown in FIG. 9. Further, the valve lift curve (open/close timing) of the exhaust valves 3 is maintained at the middle phase T2 as the phase control mechanism 40 is controlled to the middle phase position at the time of start of the engine as mentioned above.

In consequence, there is almost no valve overlap between the intake valves 2 and the exhaust valves 3; and the close timing of the intake valves 2 is set near the bottom dead center (BDC) of the engine piston at the time of start of the engine. This allows improvement in intake fill efficiency by reduction in residual gas and by increase in effective compression ratio so that the engine can achieve high torque output and good startability.

When the engine is placed in a low-speed, low-load operating state after the engine start, the control shaft 31 is rotated by the actuator 33 in such a manner that the large thickness portion 32*a* of the control cam 32 is located upwardly as mentioned above and as shown in FIG. 2. Then, the rocker arm 22, the link rod 24 and the swing cams 21 shift upwardly in a clockwise direction. As the position of contact of the swing cams 21 with the intake valve lifters 2*a* is brought closer to the base circle portions 21*b*, the amount of swinging movement of the swing cams 21 is decreased. The lift amount (operating angle) of the intake valves 2 is thus decreased to a relatively small lift amount L1 (relatively small angle).

In the case where the exhaust valves 3 are conventionally driven by the rotary cams (such as those mentioned above) with the use of no variable valve event an lift mechanism and no phase control mechanism, both of the lift amount and open/close timing of the exhaust valves 3 are fixed. As the valve lift curve (open/close timing) of the exhaust valves 3 is maintained at the middle phase T2, the close timing of the exhaust valves 3 is set near the top dead center (TDC) of the engine piston. By contrast, the open timing of the intake valves 2 is retarded relative to the TDC. As a result, there occurs a negative valve overlap OL where both of the intake and exhaust valves 2 and 3 are kept closed during the time period from the close timing of the exhaust valves 3 to the open timing of the intake valves 2. During such a negative valve overlap period, the negative pressure in the engine cylinder increases with the downward movement of the engine piston. This leads to deterioration in fuel efficiency due to increase in pumping loss.

In view of the above conventional problem, the phase control mechanism 40 is operated to rotate the inner camshaft member 14 to the retard side relative to the outer camshaft member 13 by the supply of hydraulic pressure to the retard hydraulic chambers Pr such that the open/close timing of the exhaust valves 3 is set to a retarded phase T1 in the low-speed, low-load operating state where the lift amount of the intake valves 2 is set to the small lift amount L1 in the first embodiment. Under this phase retard control, the close timing of the exhaust valves 3 and the open timing of the intake valves 2 are brought nearer to each other so as to reduce the time period TL from the close timing of the exhaust valves 3 to the open timing of the intake valves 2 (negative valve overlap period). It is thus possible to limit increase in negative cylinder pressure and prevent increase in pumping loss for improvement of fuel efficiency. It is also possible to increase the expansion stroke of the engine piston for improvement of fuel efficiency as the open timing of the exhaust valves 3 is retarded to the BDC side under the phase retard control.

When the engine is placed in a high-speed, high-load operating state with increase in engine rotation speed, the control shaft 31 is rotated by the actuator 33 in such a manner that the large thickness portion 32*a* of the control cam 32 is located downwardly as shown in FIG. 3. Then, the rocker arm 22, the link rod 24 and the swing cams 21 shift downwardly in a counterclockwise direction. As the position of contact of the swing cams 21 with the intake valve lifters 2*a* becomes closer to the cam nose portions 21*c*, the amount of swinging movements of the swing cams 21 is increased. The lift amount (operating angle) of the intake valves 2 is thus increased to a relatively large lift amount L3 (relatively small angle).

In the case where the exhaust valves 3 are conventionally driven by the rotary cam with no phase control mechanism, the valve lift curve (open/close timing) of the exhaust valves 3 is maintained at the middle phase position T2 so as to cause a large overlap OL between the close timing of the exhaust valves 3 and the open timing of the intake valves 2 as mentioned above. During such a large valve overlap period, a large amount of exhaust gas flows into the engine cylinder. This leads to deterioration in intake fill efficiency due to increase in residual gas so that the engine fails in desired high-rotation torque output.

In the first embodiment, the phase control mechanism 4 is operated to rotate the inner camshaft member 14 to the advance side relative to the outer camshaft member 13 by the supply of hydraulic pressure to the advance hydraulic chambers Pa such that the open/close timing of the exhaust valves 3 is set to an advanced phase T3 in the high-speed, high-load operating state where the lift amount of the intake valves 2 is set to the large lift amount L3. Under this phase advance control, the valve overlap OL between the intake valves 2 and the exhaust valves 3 can be reduced. It is thus possible to limit the flow of exhaust gas into the engine cylinder and achieve desired high-rotation torque output by improve in intake fill efficiency. It is also possible to obtain reduction in exhaust discharge loss, which becomes a problem in the high-speed operating range, for desired high-rotation torque output as the open timing of the exhaust valves 3 is advanced under the phase advance control.

As described above, the exhaust camshaft 10 is double-structured with the outer and inner camshaft members 13 and 14; and the relative rotation of the outer and inner camshaft members 13 and 14 is controlled by the phase control mechanism 40 in the first embodiment. By the combined adoption of such a double-structured exhaust camshaft 10 with the phase control mechanism 40, the variable valve apparatus is configured to the open/close timing of the exhaust valves 3 within the range of T1 to T3 according to the lift amount L1, L2, L3 (operating angle D1, D2, D3) of the intake valves 2 and avoid the above-mentioned conventional problems. In the first embodiment, the variable valve apparatus has a specific configuration in which the eccentric drive cam 12 is mounted on and driven by the exhaust camshaft 10 to apply a driving force to the swing cams 21 through the transmission mechanism 20 and allow opening and closing operations of the intake valves 2 as mentioned above. The variable valve apparatus is therefore able to secure good mountability due to such a specific configuration and, at the same time, optimize good relationship between the open/close timing of the intake valves 2 and the open/close timing of the exhaust valves 3 according to the operating angle of the intake valves 2.

The peak lift phase of the intake valves 2 is slightly changed with increase in the lift amount of the intake valves 2 under the condition of $\theta 1<\theta 3$ where $\theta 1$ is the angle of the link arm 23 in the small-lift control state of FIG. 2 and $\theta 3$ is the angle of the link arm 23 in the large-lift control state of FIG. 3 in the first embodiment. The peak lift phase of the intake valves 2 is slightly changed to the retard side with increase in the lift amount of the intake valves 2 in the case where the eccentric drive cams 12 are clockwisely rotated in FIGS. 2 and 3. In the case where the eccentric drive cams 12 are rotated counterclockwisely in FIGS. 2 and 3, the peak lift phase of the intake valves 2 is slightly changed to the advance side with increase in the lift amount of the intake valves 2. In either of these cases, the change in peak lift phase can be appropriately corrected by varying the open/close timing of the exhaust valves 3.

In the exhaust camshaft 10, the outer camshaft member 13 is located upstream of the inner camshaft member 14 on the torque transmission path from the engine crankshaft to the engine valves and is less susceptible to torsional deformation. As the eccentric drive cams 12 are integrally formed on such an outer camshaft member 13 to drive the intake valves 2 via the transmission mechanism 20 and the swing cams 21, the valve lift curve (change of operating angle) of the intake valves 2 can be stabilized effectively and securely. Further-more, the eccentric drive cams 12 can be supported with high support rigidity for further stabilization of the valve lift curve (change of operating angle) of the intake valves 2 as each of the eccentric drive cams 12 is integral with the relatively highly rigid outer camshaft member 13.

Relief portions are continuously formed in the exhaust camshaft 10 (outer camshaft member 13) on axially opposite sides of the eccentric drive cam 12 so as to extend over axial width ranges U as shown in FIG. 4. Each of the relief portions has a lateral cross section falling within the projection area of the eccentric drive cam 12 indicated by hatching in FIG. 6. When the axial width ranges U of the relieve portions is made larger than the thickness of the link arm 23, the link arm 23 can be fitted around the exhaust camshaft 10 in the axial direction from one end side. There is no need to form the link arm 23 with two separate pieces as in Japanese Laid-Open Patent Publication No. 2002-168105.

Figure 10:
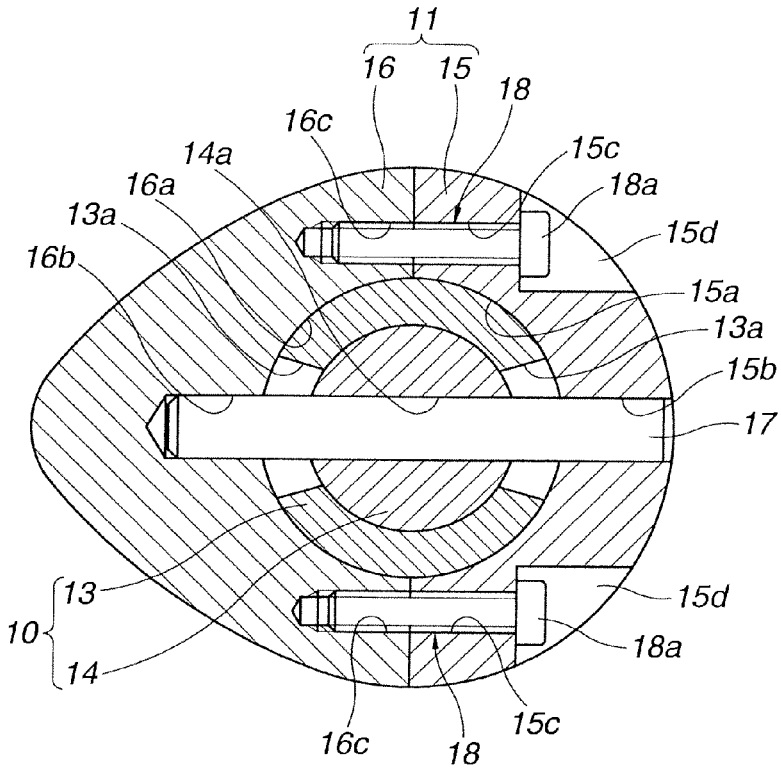
FIG. 10 is a cross-section view corresponding to FIG. 7 and showing a rotary cam of a variable valve apparatus according to a modification of the first embodiment of the present invention.

The variable valve apparatus according to the first embodiment may be modified in such a manner that the base circle cam lobe 15 and lift cam lobe 16 of the rotary cam 11 are coupled and fixed together by a plurality of bolts 18 as shown in FIG. 10. In the present modified embodiment, a pair of bolt insertion holes 15*c* are formed through both end portions of the base circle cam lobe 15 in parallel with the pin insertion hole 15*b*. Similarly, a pair of female threaded holes 16*c* are formed in both end portions of the lift cam lobe 16 at positions facing the bolt insertion holes 15*c*. The cam lobes 15 and 16 are thus assembled into the rotary cam 11 by inserting the bolts 18 in the bolt insertion holes 15*c* and screwing the bolts 18 into the threaded holes 16*c*. Spot facing portions 15*d* are formed on outer end sides of the bolt insertion holes 15*c* so as to accommodate therein head portions 18*a* of the bolts 18 and prevent the bolts 18 from protruding to the outside of the eccentric drive cam 12 and interfering with the other component parts at the time of fixing the cam lobes 15 and 16.

As described above, the cam lobes 15 and 16 are fixed together by the combined use of the bolts 18 with the fixing pin 17 in the present modified embodiment. This makes it possible to improve not only the fixing strength of the cam lobes 15 and 16 but also the support rigidity of the rotary cams 11. As the adhesion of the cam lobes 15 and 16 increases, the precision of mating of the cam lobe mating surfaces 15*a* and 16*a* can be improved for smooth rotation (sliding) of the cam lobes 15 and 16 relative to the outer camshaft member 13. The variable valve apparatus improves in durability by such secure fixing of the rotary cams 11.

Second Embodiment

Figure 11A:
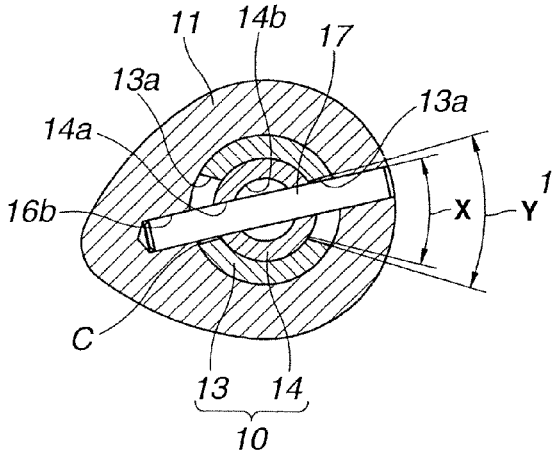
FIGS. 11A and 11B are cross-section views corresponding to FIGS. 8A and 8B and showing a rotary cam of a variable valve apparatus during phase retard control and phase advance control, respectively, according to a second embodiment of the present invention.
Figure 11B:
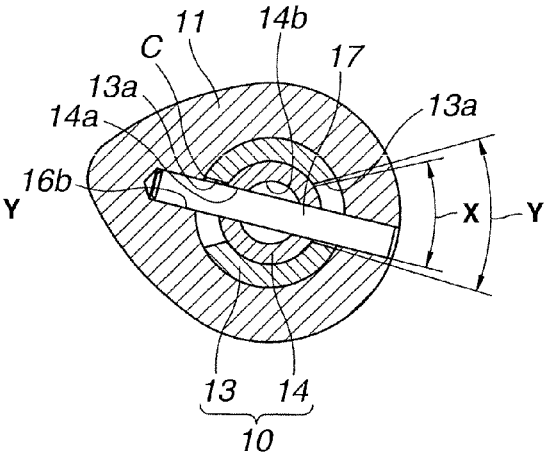

The variable valve apparatus according to the second embodiment is structurally similar to that according to the first embodiment, except that: each of the eccentric drive cams 12 is formed separately from the outer camshaft member 13 of the exhaust camshaft 10; and each of the rotary cams 11 is formed in one piece as shown in FIGS. 11A and 11B.

As the eccentric drive cams 12 are formed separately from the outer camshaft member 13, the rotary cams 11 can be fitted around the exhaust camshaft 10 from one end side. This makes it possible to form the rotary cam 11 with one-piece structure, rather than two-piece structure of two cam lobes 15 and 16, for improvements in strength and support rigidity and thereby possible to secure further stabilization of the valve lift curve of the exhaust valves 3 by smooth rotation (sliding) of the rotary cams 11.

As in the case of the first embodiment, the fixing pin 17 is inserted in the rotary cams 11 and the outer and inner camshaft members 13 and 14 so as to allow rotation of the inner camshaft member 14 together with the rotary cams 11 relative to the outer camshaft member 13 in the second embodiment. The circumferential length of the pin insertion slits 13*a* of the outer camshaft member 13 is set in such a manner that each of the pin insertion slits 13*a* has an opening formed with a given angle Y larger than a rotational angle X of the fixing pin 17 relative the outer camshaft member 13 (i.e. a phase change angle of the phase control mechanism 40) during relative rotation of the outer and inner camshaft members 13 and 14. Even when the vanes 42*b* collide with the respective shoes 41*a* due to e.g. overshoot (that is, the outer and inner camshaft members 13 and 14 rotate relative to each other by an maximum amount), there is a slight clearance C left between the fixing pin 17 and the pin insertion slits 13*a* so that the fixing pin 17 does not come into contact with ends of the pin insertion slits 13. This makes it possible to secure the strength of the fixing pin 17 and the strength of the pin insertion slits 13*a* and prevent noise caused by collision of the fixing pin 17.

In the second embodiment, the inner camshaft member 14 has a hollow shape formed with an oil gallery 14*b* along the axial direction thereof such that oil flows through the oil gallery 14*b* and then flows out through a slight clearance between the fixing pin 17 and the pin insertion hole 14*a* to lubricate sliding surfaces between the outer and inner camshaft members 13 and 14 and between the outer camshaft member 13 and the rotary cams 11 for smooth rotation of the exhaust camshaft 10 and the rotary cams 11.

Third Embodiment

Figure 12:
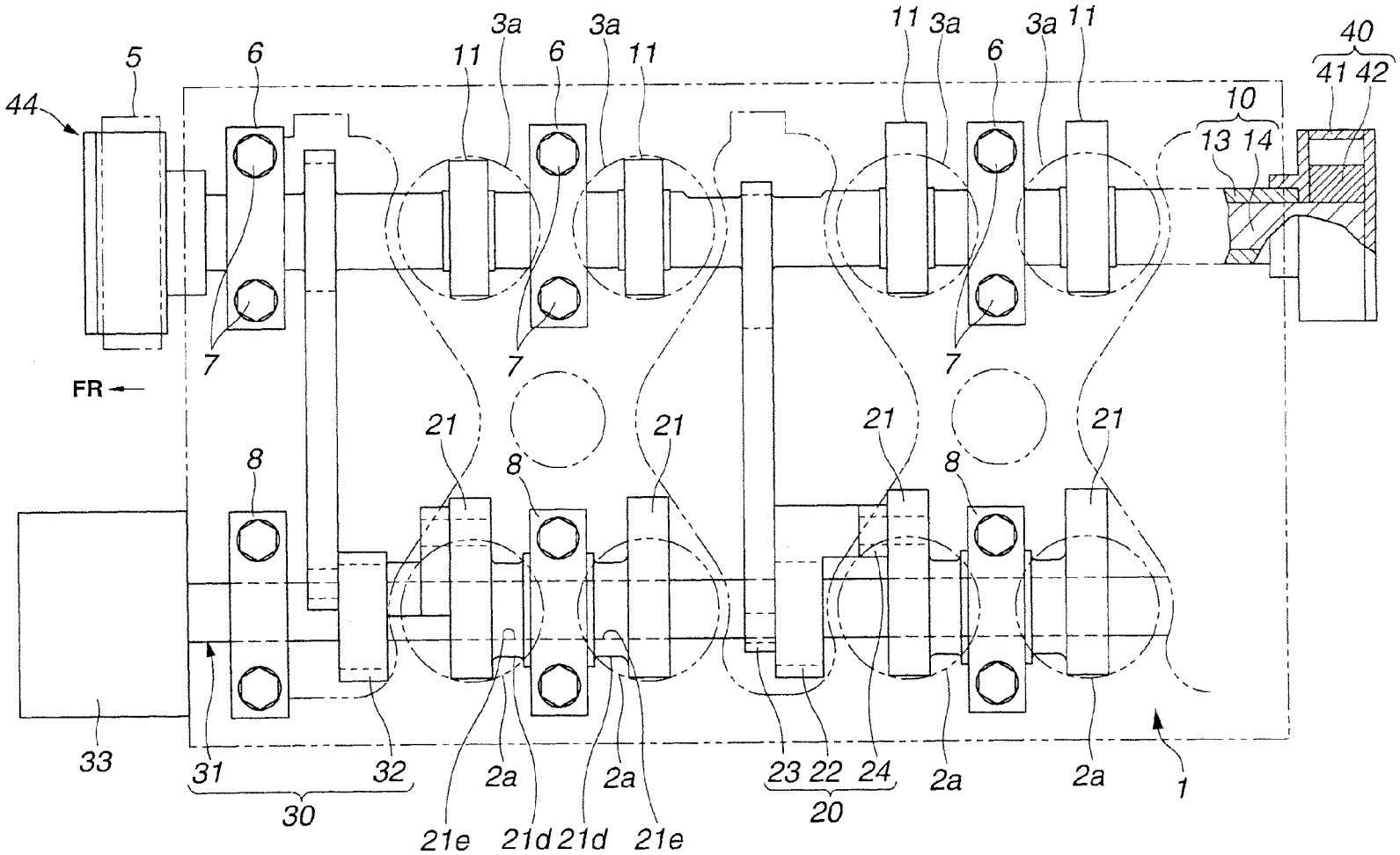
FIG. 12 is a plan view corresponding to FIG. 1 and showing a variable valve apparatus according to a third embodiment of the present invention.

The variable valve apparatus according to the third embodiment is structurally similar to that according to the first embodiment, except that another valve timing control (VTC) mechanism 44 is disposed on the end of the exhaust camshaft 10 opposite from the end on which the phase control mechanism 40 is disposed as shown in FIG. 12.

The phase control mechanism 44 is formed with the same structure as the phase control mechanism 40 and is located between the pulley 4 and the exhaust camshaft 10 so as to cause relative rotation between the pulley 4 and the outer camshaft member 13 of the exhaust camshaft 10. As mentioned above, the phase control mechanism 40 is operated to change the rotational phase of the inner camshaft member 14 to the retard side relative to the outer shaft member 13 in the small-lift control state (the amount of swinging movement of the swing cams 21 is decreased). On the other hand, the phase control mechanism 44 is operated to change the rotational phase of the outer camshaft member 13 to the advance side relative to the engine crankshaft in the small-lift control state.

Figure 13:
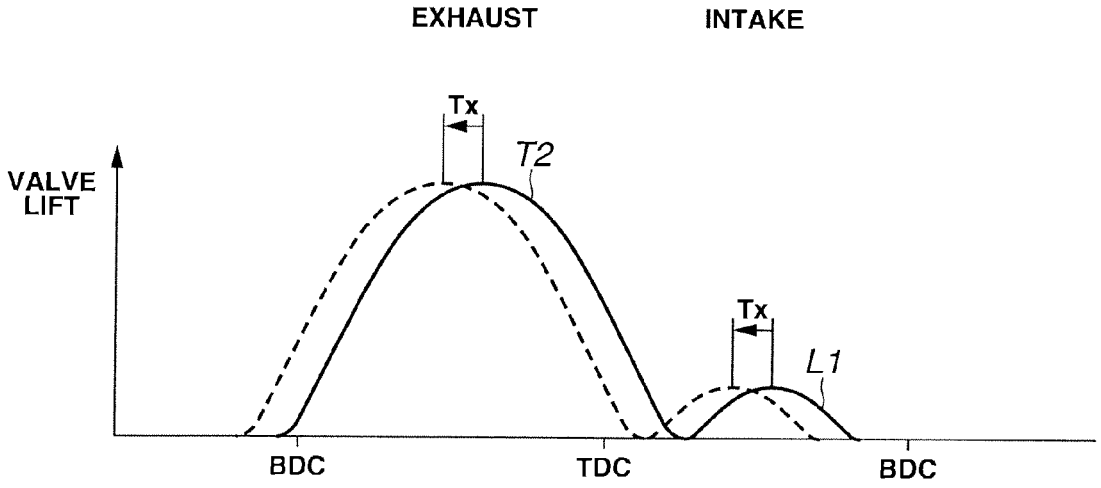
FIG. 13 is a graph showing the valve lift characteristics of intake and exhaust valves controlled by the variable valve apparatus according to the third embodiment of the present invention.

By adoption of such two phase control mechanisms 40 and 44, the variable valve apparatus is configured to vary both of the open/close timing of the intake valves 2 and the open/close timing of the exhaust valves 3 within a give phase range Tx as shown in FIG. 13. This makes it possible to control the close timing of the intake valves 2 to be more advanced than that in the first embodiment, while limiting the valve overlap between the intake valves 2 and the exhaust valves 3 as in the case of the first embodiment, and thereby possible to optimize the open/close timing of both of the intake and exhaust valves 2 and 3 and secure sufficient reduction in pumping loss for further improvement in fuel efficiency.

In the third embodiment, the open timing of the exhaust valves 3 is also advanced under the phase advance control of the phase control mechanism 44. It is conceivable that such phase advance control would cause decrease in expansion load in the engine cylinder. However, the expansion ratio of the engine is merely decreased by a slight amount due to the phase advance control as the open timing of the exhaust valves 3 is near the BDC. The influence of the advanced open timing of the exhaust valves 3 on the fuel efficiency is thus relatively small. On the whole, the fuel efficiency improvement effect of the advanced close timing of the intake valves 2 exceeds the influence of the advanced open timing of the exhaust valves 2 so as to obtain further improvement in fuel efficiency as mentioned above.

Fourth Embodiment

Figure 14:
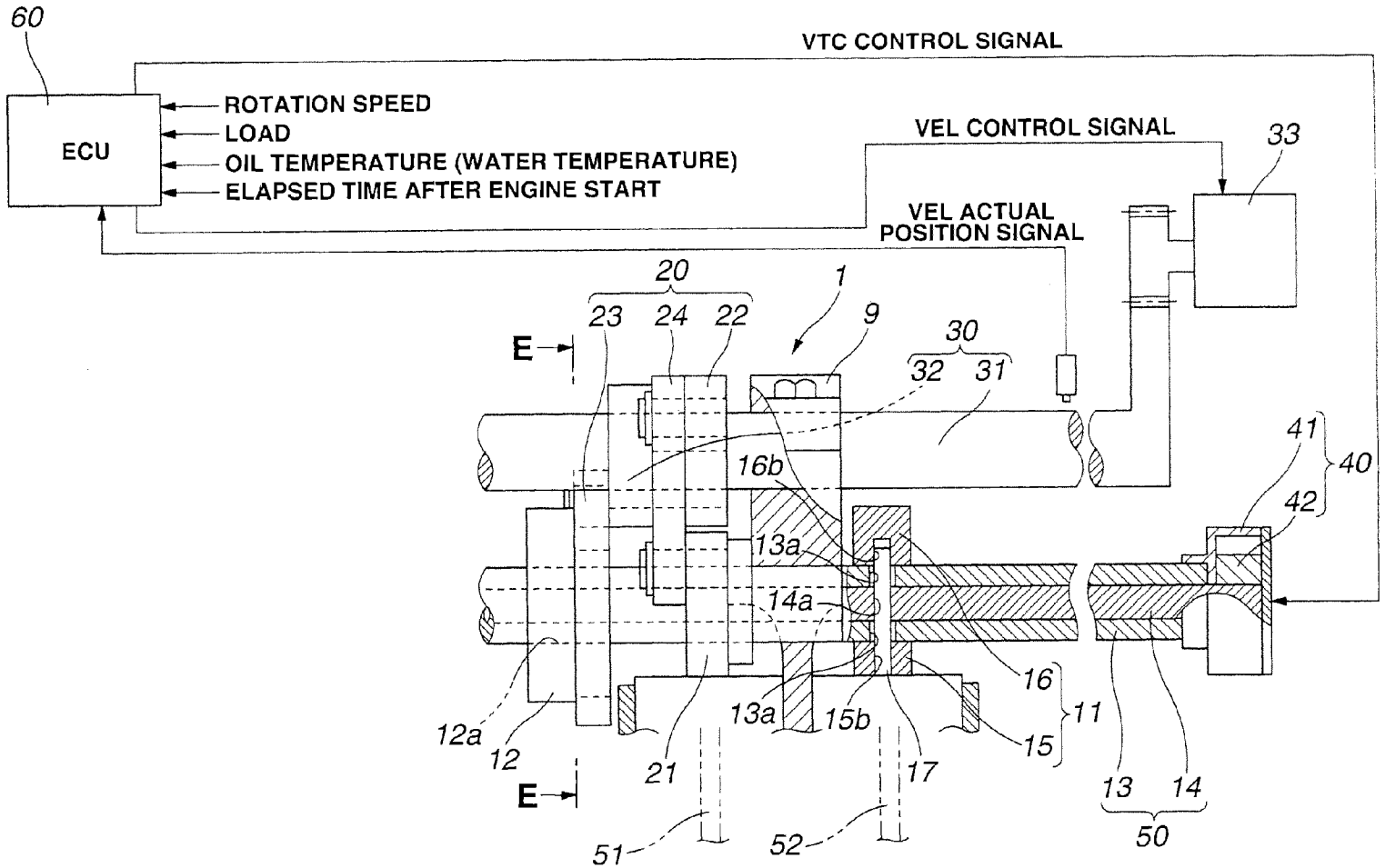
FIG. 14 is a schematic view of substantial part of a variable valve apparatus according to a fourth embodiment of the present invention.

The variable valve apparatus according to the fourth embodiment is structurally similar to that according to the first embodiment, except that the variable valve apparatus is provided with an intake camshaft 50 as an independent drive shaft to drive intake valves 51 and 52 (hereinafter referred to as "first and second intake valves") per engine cylinder; and the transmission mechanism 20 is disposed between the intake camshaft 50 and the control shaft 31 as shown in FIG. 14. In FIG. 14, "VEL" is an abbreviation for the variable valve event and lift mechanism; and "VTC" is an abbreviation for the valve timing control mechanism (phase control mechanism).

As shown in FIG. 14, the intake camshaft 50 is arranged along the front-rear direction of the engine and is rotatably disposed on the upper side of the engine cylinder head 1 by bearings 9.

In the fourth embodiment, the intake camshaft 50 has a double structure formed with a hollow outer camshaft member 13 (as a first camshaft member) and a solid inner camshaft member 14 (as a second camshaft member) as in the case of the exhaust camshaft 10 of the first embodiment. The outer camshaft member 13 is supported rotatably on the bearings 9 such that rotation of the engine crankshaft is transmitted to one end of the outer camshaft member 13 via a pulley and a timing belt (not shown). The inner camshaft member 14 is inserted rotatably and coaxially through an axial hole of the outer camshaft member 13.

The swing cams 21 are rotatably supported on the intake camshaft 50 at positions axially corresponding to the first intake valves 51 of the respective engine cylinders.

The rotary cams 11 are mounted on the intake camshaft 50 at positions axially corresponding to the second intake valves 52 of the respective engine cylinders. Each of the rotary cams 11 is formed with one-piece structure as in the case of the first embodiment (see FIGS. 8A and 8B) or two-piece structure as in the case of the second embodiment (see FIGS. 11A and 11B) and is fixed by the fixing pin 17 to the intake camshaft 50 so as to allow rotation of the inner camshaft member 14 together with the rotary cams 11 relative to the outer camshaft member 13.

The eccentric drive cams 12 are mounted on the intake camshaft 50 (outer camshaft member 13) on sides of the swing cams 21 opposite from the rotary cams 11. Each of the eccentric drive cams 12 has a center n offset by a predetermined amount γ from a center m of the intake camshaft 50. A shaft insertion hole 12*a* is formed in the eccentric drive cam 12 along an axial direction of the intake camshaft 50 (i.e. a thickness direction of the eccentric drive cam 12) such that the intake camshaft 50 is inserted and press fitted in the shaft insertion holes 12*a* of the eccentric drive cams 12 so as to allow rotation of the outer camshaft member 13 together with the eccentric drive cams 12.

Figure 15:
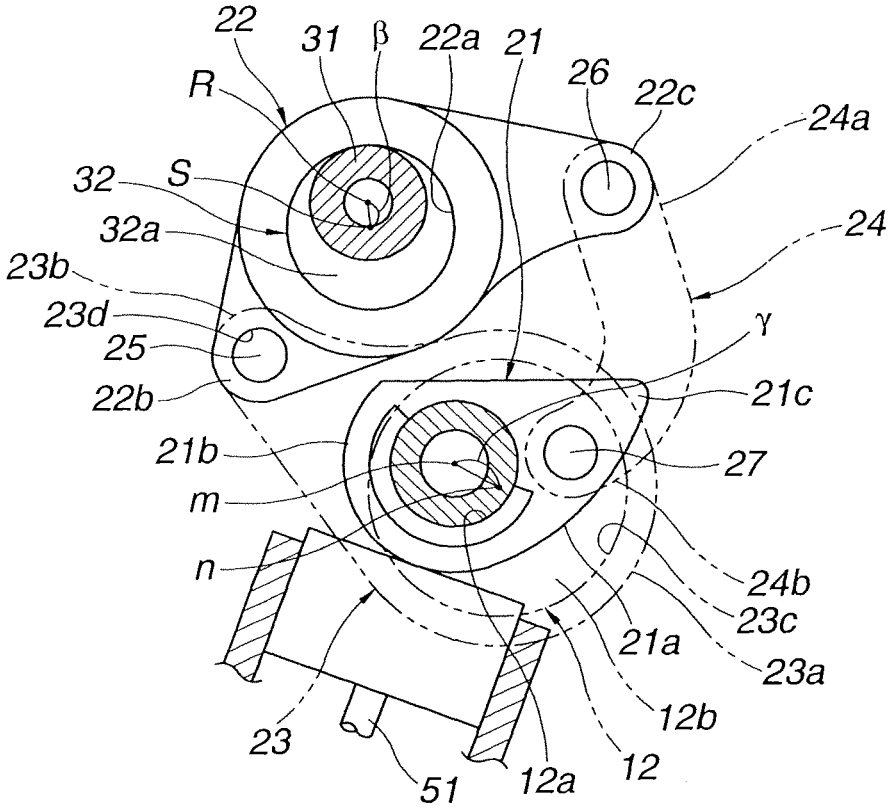
FIGS. 15, 16A and 16B are cross-section views taken along line E-E of FIG. 14 and showing non-, small- and large-lift control states of the variable valve apparatus, respectively, according to the fourth embodiment of the present invention.

In the variable valve event and lift mechanism 30, the eccentric control cams 32 are fixed on the control shaft 31 as shown in FIGS. 14 and 15. The control shaft 31 is rotated by the actuator 33 under control signals from an electronic control unit 60 according to engine operating conditions such as engine rotation speed, oil temperature, coolant temperature etc. detected by sensors. The variable valve event and lift mechanism 30 is thus adapted to vary the valve lift characteristics of the first intake valves 51 by controlling the rotational phase of the control shaft 31 and thereby allowing the control cams 32 to change the position of contact of the swing cams 21 with valve lifters of the first intake valves 51.

The transmission mechanism 20 is provided with the rocker arm 22, the link arm 23 and the link rod 24 per engine cylinder.

The rocker arm 22 is disposed above the intake camshaft 50 (swing cam 21) and rotatably supported on the eccentric body portion 32*a* of the control cam 32. A cam insertion hole 22*a* is formed in the center base portion of the rocker arm 22 so that the rocker arm 22 is swingably supported on the control cam 32 by insertion of the control cam 32 into the cam insertion hole 22*a*.

The link arm 23 is arranged to link one end 22*b* of the rocker arm 22 to the eccentric drive cam 12. The link arm 23 has a large-diameter base end portion 23*a* formed on one end thereof and a small-diameter protruding end portion 23*b* formed on the other end thereof protrudingly from the base end portion 23*a* and fitted to the one end 22*b* of the rocker arm 22 by the pin 25. A cam insertion hole 23*c* is formed in the center of the base end portion 23*a* of the link arm 23 so that the link arm 23 is rotatably fitted around the eccentric drive cam 12 by insertion of the eccentric body portion 12*b* of the eccentric drive cam 12 into the cam insertion hole 23*c*. The protruding end portion 23*b* of the link arm 23 is formed with a pin insertion hole 23*d* and rotatably connected to the one end 22*b* of the rocker arm 22 by fitting a pin 25 into the pin insertion hole 23*d* and the pin insertion hole of the one end 22*b* of the rocker arm 22.

The link rod 24 is bent-shaped and arranged to link the other end 22*c* of the rocker arm 22 to the swing cam 21. The one end 24*a* of the link rod 24 is rotatably connected to the end 22*c* of the rocker arm 22 by a pin 26, whereas the other end 24*b* of the link rod 24 is rotatably connected to the cam nose portion 21*c* of the swing cam 21 by a pin 27.

The phase control mechanism 40 is disposed between the outer and inner camshaft members 13 and 14 of the intake camshaft 50 and formed with the same structure as in the first embodiment so as to control relative rotation of the outer and inner camshaft member 13. In the forth embodiment, the phase control mechanism 40 is adapted to lock the vane rotor 42 in a most retarded phase position under the engine stop conditions.

The operations of the variable valve apparatus according to the fourth embodiment will be explained below.

Figure 17:
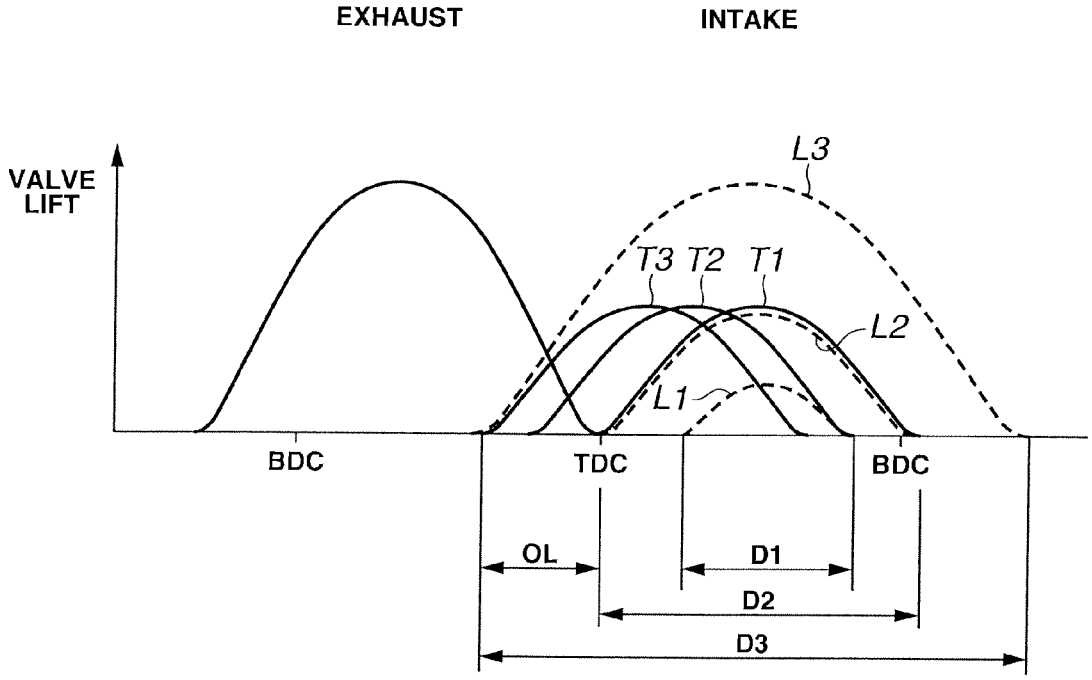
FIG. 17 is a graph showing the valve lift characteristics of intake and exhaust valves controlled by the variable valve apparatus according to the fourth embodiment of the present invention.

When the eccentric drive cam 12 rotates together with the outer camshaft member 13 of the intake camshaft 50, the rotation of the eccentric drive cam 12 is converted to liner movement of the link arm 23. By such linear movement of the link arm 23, the rocker arm 22 swings to move the link rod 24 and thereby cause swinging movement of the swing cam 21. The first intake valve 51 of each engine cylinder is opened and closed by swinging movement of the swing cam 21. At this time, the valve lift characteristics of the first intake valves 51 are controlled by the variable valve event and lift mechanism 30 according to the engine operating conditions. At the time of start of the engine, the lift amount (operating angle) of the first intake valves 51 is set to a middle lift amount L2 (middle operating angle D2) as shown in FIG. 17. Further, the valve lift curve (open/close timing) of the first intake valves 51 is set to a most retarded phase T1 at the time of start of the engine.

On the other hand, the second intake valve 52 of each engine cylinder is opened and closed with the rotation of the rotary cam 11 when the rotary cam 11 rotates together with the inner camshaft member 14 of the intake camshaft 50. The lift amount of the second intake valves 52 is fixed at a middle lift amount L2; and the valve lift curve (open/close timing) of the second intake valves 52 is set to a most retarded phase T1 at the time of start of the engine.

The valve lift characteristics of the first intake valves 51 are thus substantially the same as those of the second intake valves 52 at the time of start of the engine. In consequence, there is almost no valve overlap between the first and second intake valves 51 and 52 and the exhaust valves; and the close timing of each of the first and second intake valves 51 and 52 is set near the BDC. This allows improvement in intake fill efficiency by reduction in residual gas and by increase in effective compression ratio so that the engine can achieve high torque output and good startability as in the case of the first embodiment.

Figure 16B:
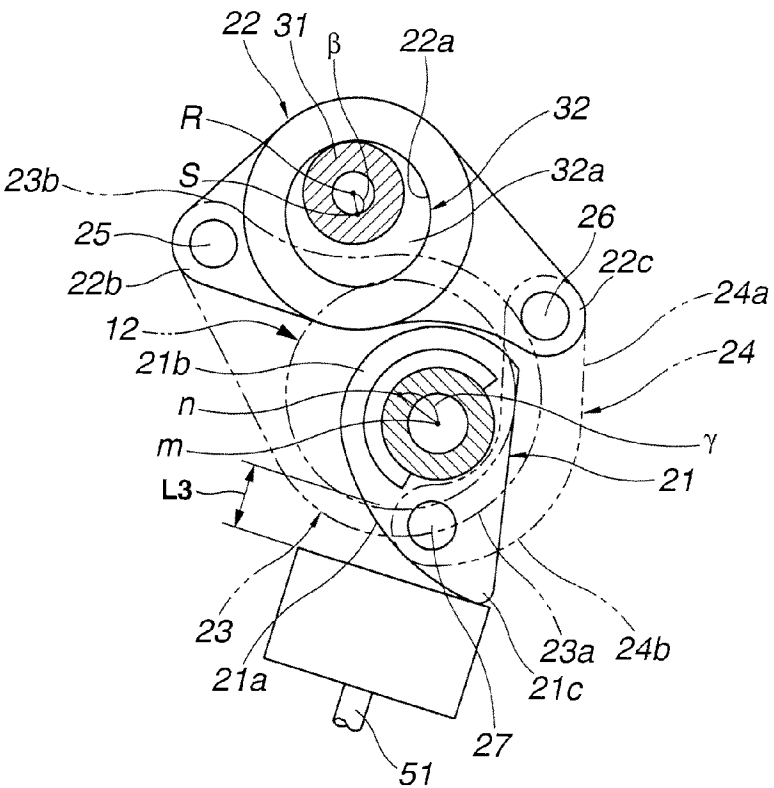
Figure 16A:
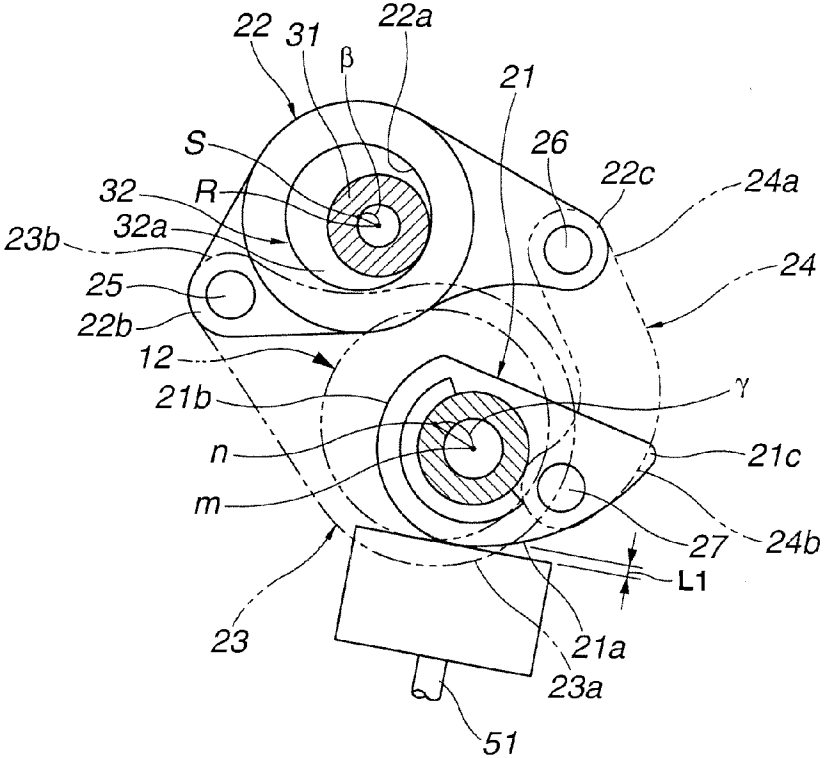

When the engine is placed in a low-speed, low-load operating state after the engine start, the control shaft 31 is rotated by the actuator 33 in such a manner that the large thickness portion 32*a* of the control cam 32 is located upwardly as shown in FIG. 16A. Then, the rocker arm 22 shifts upwardly relative to the intake camshaft 50. The lift amount (operating angle) of the intake valves 51 is thus decreased to a relatively small lift amount L1 (relatively small angle D1). By such valve lift control, it is expected to obtain a pumping loss reduction effect on the first intake valves 51. However, the valve lift characteristics of the second intake valves 52 are not controlled. As the close timing of the second intake valves 52 is kept near the BDC, it cannot not be expected to obtain a sufficient pumping loss reduction effect on the second intake valves 52.

In view of such a problem, the phase control mechanism 40 is operated to rotate the inner camshaft member 14 to the advance side relative to the outer camshaft member 13 so as to advance the open/close timing of the second intake valves 52 to a middle phase T2 in the low-speed, low-load operating state where the lift amount of the intake valves 2 is set to the small lift amount L1 in the fourth embodiment. Under this phase advance control, the close timing of the second intake valves 52 is set to the same timing as the close timing of the first intake valves 51. It is thus possible to secure sufficient reduction in pumping loss for improvement in fuel efficiency.

In the fourth embodiment, the open timing of the second intake valves 51 is also advanced under the phase advance control. It is conceivable that such phase advance control would cause deterioration in combustion efficiency as the internal EGR increases with valve overlap OL in the low-load operating state. However, there occurs a swirl due to a difference between the open timing of the first intake valves 51 and the open timing of the second intake valves 52. As the internal EGR increases under the intake swirl effect, it is possible to prevent deterioration in combustion efficiency and thereby obtain further reduction in pumping loss and increase in specific heat ratio of air-fuel mixture for further improvement in fuel efficiency.

When the engine is placed in a high-speed, high-load operating state with increase in engine rotation speed, the cycle time of the engine becomes shortened. In this state, the control shaft 31 is rotated by the actuator 33 in such a manner that the large thickness portion 32*a* of the control cam 32 is located downwardly as shown in FIG. 16B for improvement in intake fill efficiency. Then, the rocker arm 22 shifts downwardly relative to the intake camshaft 50. The lift amount (operating angle) of the intake valves 51 is thus increased to a relatively large lift amount L3 (relatively small angle D3). However, there arises a great intake swirl due to a large difference between the open timing of the first intake valves 51 and the open timing of the second intake valves 52. This leads to decrease in intake efficiency in the occurrence of a swirl from the early intake stage.

In the fourth embodiment, the phase control mechanism 40 is operated to further rotate the inner camshaft member 14 to the advance side relative to the outer camshaft member 13 so as to advance the open/close timing of the second intake valves 52 to an advanced phase T3 in the high-speed, high-load operating state where the lift amount of the intake valves 2 is set to the large lift amount L3. Under this phase advance control, the open timing of the second intake valves 52 is set nearer to the open timing of the first intake valves 51. It is thus possible to limit the swirl effect in the early intake stage and prevent deterioration in intake fill efficiency so that the engine can achieve high torque output.

As described above, the intake camshaft 50 is double-structured with the outer and inner camshaft members 13 and 14; and the relative rotation of the outer and inner camshaft members 13 and 14 is controlled by the phase control mechanism 40 in the fourth embodiment. By the combined adoption of such a double-structured intake camshaft 50 with the phase control mechanism, the variable valve apparatus is configured to vary the open/close timing of the second intake valves 51 within the range of T1 to T3 according to the lift amount L1, L2, L3 (operating angle D1, D2, D3) of the first intake valves 51 and is therefore able to avoid the above-mentioned conventional problems and optimize good relationship between the open/close timing of the first intake valves 51 and the open/close timing of the second intake valves 52.

If the double-structured intake camshaft 50 is not adopted in the variable valve apparatus, two camshafts (corresponding to the outer and inner camshaft members 13 and 14) need to be provided and spaced apart from each other in the width direction or height direction of the engine. In this case, the mountability of the variable valve apparatus decreases with increase in the dimension of the variable valve apparatus in the engine width or height direction.

In the fourth embodiment, by contrast, the intake camshaft 50 has a double structure in which the outer and inner camshaft members 13 and 14 (first and second camshaft members) are coaxial with each other as mentioned above. As the dimension of the variable valve apparatus in the engine width or height direction can be made relatively small, the variable valve apparatus is able to secure good mountability in the fourth embodiment as in the case of the first embodiment.

The entire contents of Japanese Patent Application No. 2012-34608 (filed on Feb. 21, 2012) are herein incorporated by reference.

Although the present invention has been described with reference to the above exemplary embodiments, the present invention is not limited to these exemplary embodiments. Various modification and variation of the embodiments described above will occur to those skilled in the art in light of the above teachings.

In the present invention, the intake valve 2, 51 is preferably operated by the swing cam 21 as in the first to fourth embodiments although the swing cam 21 can be used to operate either the intake valve or the exhaust valve.

In the first to fourth embodiments, the variable valve event and lift mechanism 30 is adapted to change the operating position of the swing cams 21 with rotation of the control shaft 31. However, the variable valve event and lift mechanism 30 is not limited to the above configuration and may alternatively be adapted to change the operating position of the swing cam 21 by axial movement of the control shaft 31 as disclosed in Japanese Laid-Open Patent Publication No. 2011-174416.

Further, each of the drive cams 12 is eccentric in shape in the first to fourth embodiments. The drive cams 12 are not however limited to such an eccentric shape and may alternatively be e.g. egg-shaped as disclosed in Japanese Laid-Open Patent Publication No. S55-137305.

Although the fixing pin 17 is used as relative rotation preventing means to prevent rotation of the rotary cams 11 relative to the inner camshaft member 14 (i.e. to allow the rotary cams 11 to rotate together with the inner camshaft member 14) in the first to fourth embodiments, the relative rotation preventing means is not limited to the fixing pin 17. It is alternatively feasible to insert a hexagonal shaft into the inner camshaft member 14 and thereby prevent relative rotation of the rotary cams 11 by the hexagonal shaft as disclosed in SAE-860537.

In the first to fourth embodiments, the rotation of the engine crankshaft is transmitted to the outer camshaft member 13 via the pulley and timing belt. Alternatively, it is feasible to use the inner and outer camshaft members 14 and 13 as the first and inner camshaft members, respectively, and transmit the rotation of the engine crankshaft to the inner camshaft member 14. In this case, the phase control mechanism 40 is adapted to control the rotational phase of either the rotary cams 11 or the eccentric drive cams 12 fixed to the outer camshaft member 13.

Although the rotary cams 11 (with which the variable valve event and lift mechanism 30 is not associated) are fixed to the inner crankshaft member 14 in the first to third embodiments, the eccentric drive cams 12 (with which the variable valve event and lift mechanism 30 is associated) may alternatively be fixed to the inner crankshaft member 14. In such a case, the variable valve apparatus is configured to control the lift amount of the intake valves 2 by the variable valve event and lift mechanism 30 to the small lift amount L1 in FIG. 9 and, at the same time, advance the valve lift phase of the intake valves 2 by the phase control mechanism 40. By contrast, the valve lift characteristics of the exhaust valves 3 are fixed. This makes it possible to, while limiting the negative valve overlap period TL, control the close timing of the intake valves 2 to be more advanced for further reduction in pumping loss.

In the first to third embodiments, the link arm 23 is adopted to convert the rotation of the eccentric drive cam 12 to the swinging movement of the rocker arm 22; and the control shaft 31 is located nearer to the intake valve 2 than a midpoint between the intake valve 2 and the exhaust valve 3 on the engine cylinder head 1. In this configuration, the valve lift characteristics of the intake valve 2 can be varied to control the operating factors directly related to the combustion of fuel in the engine (such as intake swirl and pumping loss) for improvement in fuel efficiency. It is alternatively feasible to locate the control shaft 31 at a position nearer to the exhaust valve 3 than a midpoint between the intake valve 2 and the exhaust valve 3 on the engine cylinder head 1 so that the valve lift characteristic of the exhaust valve 3 can be varied for exhaust emission improvement and other merits.

In the fourth embodiment, the double-structured intake camshaft 50 and the phase control mechanism 40 are adopted to optimize the open/close timing of the first and second intake valves 51 and 52 in each engine cylinder. It is alternatively feasible to adopt the same camshaft/phase control configuration in order to optimize the open/close timing of first and second exhaust valves in each engine cylinder. For example, the variable valve apparatus may be provided with a double-structured exhaust camshaft and a phase control mechanism so as to vary the valve lift phase of the second exhaust valve according to the valve lift characteristics of the first exhaust valve. In such a case, the valve lift curve of the first exhaust valve can be started during the intake stroke after the end of the valve lift curve of the second exhaust valve. This has a merit of allowing a large amount of residual gas to be accurately introduced through the first exhaust valve during the intake stroke as compared to the case of introducing residual gas by the valve overlap. The operating angle of the first exhaust valve can also be varied during the intake stroke according to the engine operating conditions. It is thus possible to achieve high levels of NOx and fuel efficiency improvement in the internal combustion engine e.g. diesel engine.

The scope of the present invention is defined with reference to the following claims.

What is claimed is:

1. A variable valve apparatus for an internal combustion engine, comprising:

a control shaft rotatably arranged on a cylinder head of the internal combustion engine;

a camshaft rotatably arranged on the cylinder head of the internal combustion engine and having a first camshaft member to which rotation of a crankshaft of the internal combustion engine is transmitted and a second camshaft member inserted and supported in an axial hole of the first camshaft member such that the first and second camshaft members are rotatable relative to each other;

a rotary cam mounted on the second camshaft member so as to rotate together with the second camshaft member and allow opening and closing operations of an exhaust valve;

an eccentric drive cam mounted on the first camshaft member so as to rotate together with the first camshaft member;

a rocker arm swingably supported on the control shaft and caused to swing with rotation of the eccentric drive cam;

a swing cam swingably supported on the control shaft and caused to swing with swinging movement of the rocker arm and allow opening and closing operations of an intake valve;

a control cam formed eccentrically on the control shaft so as to rotate together with the control shaft, change an operating position of the rocker arm according to a rotational phase of the control shaft and thereby vary the amount of swinging movement of the swing cam;

a phase control mechanism adapted to control a rotational phase of the second camshaft member relative to the first camshaft member; and an actuator for rotating the control shaft.

2. The variable valve apparatus according to claim 1, further comprising a link arm that converts the rotation of the eccentric drive cam to the swinging movement of the rocker arm.

3. The variable valve apparatus according to claim 2, wherein the control shaft is located at a position nearer to the intake valve than a midpoint between the intake valve and the exhaust valve on the cylinder head of the internal combustion engine.

4. The variable valve apparatus according to claim 2, wherein the control shaft is located at a position nearer to the exhaust valve than a midpoint between the intake valve and the exhaust valve on the cylinder head of the internal combustion engine.

5. The variable valve apparatus according to claim 1, wherein the rotary cam is formed with two pieces and fixed to the second camshaft member by a fixing pin in such a manner that the two pieces of the rotary cam sandwich therebetween the second camshaft member with an outer circumferential surface of the second camshaft member slightly spaced apart from the two pieces of the rotary cam.

6. The variable valve apparatus according to claim 5, wherein the two pieces of the rotary cam are coupled together by a bolt.

7. The variable valve apparatus according to claim 5, wherein the fixing pin is press-fitted in the two pieces of the rotary cam such that the two pieces of the rotary cam are coupled together by the fixing pin; and wherein the fixing pin is further press-fitted in the second camshaft member.

8. The variable valve apparatus according to claim 5, wherein the fixing pin is press-fitted in the two pieces of the rotary cam such that the two pieces of the rotary cams are coupled together by the fixing pin; and wherein the fixing pin is inserted in the second camshaft member with a slight clearance left therebetween.

9. The variable valve apparatus according to claim 5, wherein the eccentric drive cam is formed integrally on the first camshaft member.

10. The variable valve apparatus according to claim 1, wherein the phase control mechanism includes a housing being rotatable in synchronism with the first camshaft member and a vane member accommodated in the housing, being rotatable in synchronism with the second camshaft member and having vanes extending radially thereof, so as to define advance and retard hydraulic chambers by the vanes in the housing and advance or retard a rotational phase of the vane member relative to the vane member by selective supply and discharge of hydraulic pressure to and from the advance and retard hydraulic chambers.

11. The variable valve apparatus according to claim 1, wherein the rotational phase of the second camshaft member relative to the first camshaft member is changed to a retard side when the amount of swinging movement of the swing cam is decreased.

12. The variable valve apparatus according to claim 1, wherein the rotational phase of the second camshaft member relative to the first camshaft member is changed to an advance side when the amount of swinging movement of the swing cam is increased.

13. The variable valve apparatus according to claim 1, wherein the rotational phase of the second camshaft member relative to the first camshaft member is controlled in such a manner as to bring an open timing of the intake valve and a close timing of the exhaust valve nearer to each other.

14. The variable valve apparatus according to claim 1, further comprising a second phase control mechanism adapted to control a rotational phase of the first member relative to the crankshaft of the internal combustion engine.

15. The variable valve apparatus according to claim 14, wherein the rotational phase of the first camshaft member relative to the crankshaft and the rotational phase of the second camshaft member relative to the first camshaft member are changed to an advance side and a retard side, respectively, when the amount of swinging movement of the swing cam is decreased.

16. A variable valve apparatus for an internal combustion engine, comprising:

a control shaft rotatably arranged on a cylinder head of the internal combustion engine;

a camshaft rotatably arranged on the cylinder head of the internal combustion engine and having a first camshaft member to which rotation of a crankshaft of the internal combustion engine is transmitted and a second camshaft member inserted and supported in an axial hole of the first camshaft member such that the first and second camshaft members are rotatable relative to each other;

a phase control mechanism disposed at one end of the camshaft and adapted to control a rotational phase of the second camshaft member relative to the first camshaft member;

a rotary cam mounted on one of the first and second camshaft members so as to rotate together with the one of the first and second camshaft members and allow opening and closing operations of an exhaust valve;

an eccentric drive cam mounted on the other of the first and second camshaft members so as to rotate together with the other of the first and second camshaft members;

a rocker arm swingably supported on the control shaft and caused to swing with rotation of the eccentric drive cam;

a swing cam swingably supported on the control shaft and caused to swing with swinging movement of the rocker arm and allow opening and closing operations of an intake valve;

a control cam formed eccentrically on the control shaft so as to rotate together with the control shaft, change an operating position of the rocker arm according to a rotational position of the control shaft and thereby control the amount of swinging movement of the swing cam; and an actuator for rotating the control shaft.

17. The variable valve apparatus according to claim 16, wherein the rotary cam is mounted on the first camshaft member so as to rotate together with the first camshaft member; and wherein the eccentric drive cam is mounted on the second camshaft member so as to rotate together with the second camshaft member.

18. The variable valve apparatus according to claim 17, wherein the rotational phase of the second camshaft member relative to the first camshaft member is changed to an advance side when the amount of swinging movement of the swing cam is decreased.

19. The variable valve apparatus according to claim 17, wherein the rotational phase of the second camshaft member relative to the first camshaft member is changed to a retard side when the amount of swinging movement of the swing cam is increased.

20. A variable valve apparatus for an internal combustion engine, comprising:

a control shaft rotatably arranged on an cylinder head of the internal combustion engine;

a camshaft rotatably arranged on an cylinder head of the internal combustion engine and having a first camshaft member to which rotation is transmitted from the internal combustion engine and a second camshaft member with a center thereof passing through the first camshaft member;

a phase control mechanism disposed at one end of the camshaft and adapted to control a rotational phase of the second camshaft member relative to the first camshaft member;

a rotary cam mounted on one of the first and second camshaft members so as to rotate together with the one of the first and second camshaft members and allow opening and closing operations of either one of intake and exhaust valves;

a drive cam mounted on the other of the first and second camshaft members so as to rotate together with the other of the first and second camshaft members;

a transmission mechanism for converting rotation of the drive cam to swinging movement and transmitting the swinging movement;

a swing cam swingably supported on the control shaft and caused to swing with the swinging movement of the transmission mechanism and allow opening and closing operations of the other of the intake and exhaust valves;

a control member integrally mounted on the control shaft and adapted to control the amount of the swinging movement of the transmission mechanism according to an operating phase thereof; and an actuator for rotating the control shaft.

* * * * *